US009383087B2

(12) United States Patent
Rashidi Doust

(10) Patent No.: US 9,383,087 B2
(45) Date of Patent: Jul. 5, 2016

(54) ADJUSTABLE RECESSED LIGHT FIXTURE

(71) Applicant: Hamid Rashidi Doust, Beverly Hills, CA (US)

(72) Inventor: Hamid Rashidi Doust, Beverly Hills, CA (US)

(73) Assignee: Elite Lighting, Commerce, CA (US)

( * ) Notice: Subject to any disclaimer, the term of this patent is extended or adjusted under 35 U.S.C. 154(b) by 0 days.

(21) Appl. No.: 14/197,804

(22) Filed: Mar. 5, 2014

(65) Prior Publication Data

US 2015/0252988 A1 Sep. 10, 2015

(51) Int. Cl.

| | |
|---|---|
| ***F21S 8/02*** | (2006.01) |
| ***F21V 21/04*** | (2006.01) |
| ***F21V 29/70*** | (2015.01) |

(52) U.S. Cl.

CPC ..... *F21V 21/049* (2013.01); *F21S 8/026* (2013.01); *F21V 29/70* (2015.01)

(58) Field of Classification Search

CPC .. F21S 8/026; F21S 8/028; F21S 8/04–8/043; F21V 21/02; F21V 21/047–21/049; F21V 21/108; F21V 21/116; F21V 21/14; F21V 21/22; F21V 29/74

See application file for complete search history.

(56) References Cited

U.S. PATENT DOCUMENTS

| | | | | |
|---|---|---|---|---|
| 3,313,931 | A | 4/1967 | Klugman | |
| 3,518,420 | A * | 6/1970 | Kripp | F21S 8/02 248/343 |
| 4,048,414 | A | 9/1977 | Frielingsdorf et al. | |
| 5,221,069 | A | 6/1993 | Struthers | |
| 5,222,800 | A | 6/1993 | Chan | |
| 5,588,737 | A | 12/1996 | Kusmer | |
| 5,609,414 | A | 3/1997 | Caluori | |
| 5,931,432 | A | 8/1999 | Herold | |
| 6,272,794 | B1 | 8/2001 | Rippel | |
| 6,283,430 | B1 | 9/2001 | Schubert | |
| 6,336,613 | B1 | 1/2002 | Roth | |
| 7,530,705 | B2 | 5/2009 | Czech | |
| 7,530,717 | B2 | 5/2009 | Magisano | |
| 7,628,367 | B2 | 12/2009 | Friederich | |
| 7,967,481 | B2 | 6/2011 | Seo | |
| 8,038,113 | B2 | 10/2011 | Fryzek | |
| 8,066,413 | B2 | 11/2011 | Czech | |
| 8,201,975 | B1 | 6/2012 | Chen | |
| 8,297,804 | B2 | 10/2012 | Buse | |
| 8,337,055 | B2 | 12/2012 | Clifton | |
| 8,408,759 | B1 | 4/2013 | Rashidi | |
| 8,444,302 | B1 | 5/2013 | Barboza | |
| 8,465,182 | B1 | 6/2013 | Davis | |
| 8,544,807 | B2 | 10/2013 | Foreman | |
| 2009/0080189 | A1 * | 3/2009 | Wegner | F21S 8/02 362/235 |
| 2013/0170232 | A1 | 7/2013 | Park et al. | |
| 2013/0272001 | A1 | 10/2013 | Lyu et al. | |

FOREIGN PATENT DOCUMENTS

| | | |
|---|---|---|
| CN | 201368383 Y | 12/2009 |
| CN | 202074442 U | 12/2011 |

OTHER PUBLICATIONS

Usai Triden Multi-function Housing, 2008-00-00.

* cited by examiner

*Primary Examiner* — Elmito Breval
*Assistant Examiner* — Nathaniel Lee
(74) *Attorney, Agent, or Firm* — Payam Moradian

(57) ABSTRACT

Provided is an adjustable recessed light fixture that can be used with a variety and a plurality of reflectors and heat sinks. This adjustable light fixture allows a user to buy a single type of fixture and adjust the fixture as needed based on the number and type of reflectors and/or heat sinks that are used.

23 Claims, 53 Drawing Sheets

FIG 10A
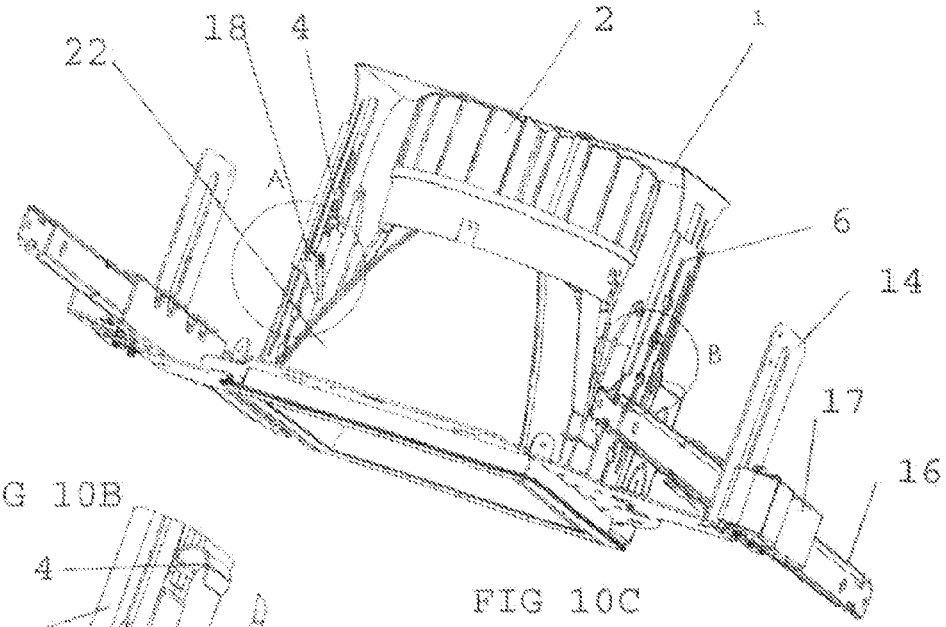
FIG 10B
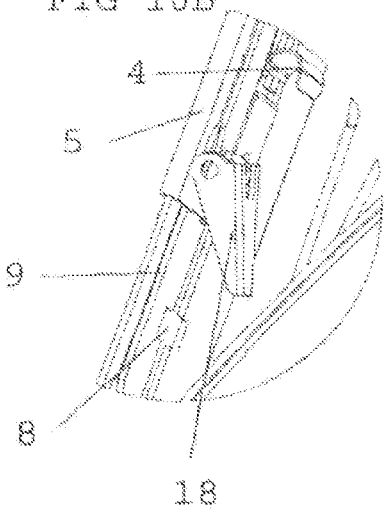
FIG 10C
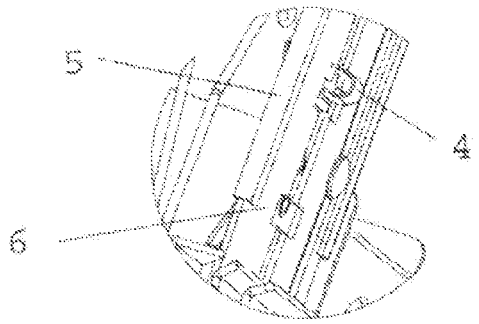
FIG 10

Fig. 20A
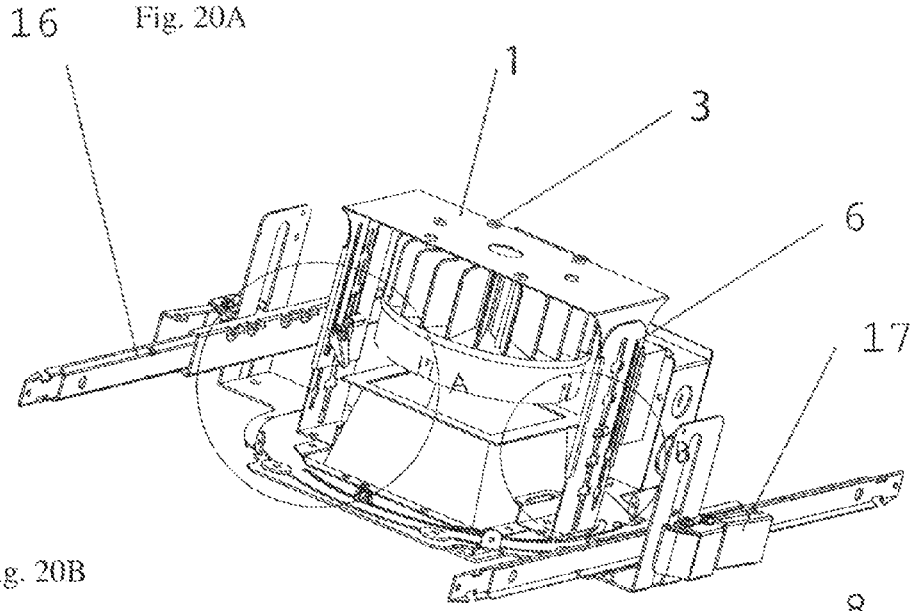
Fig. 20B
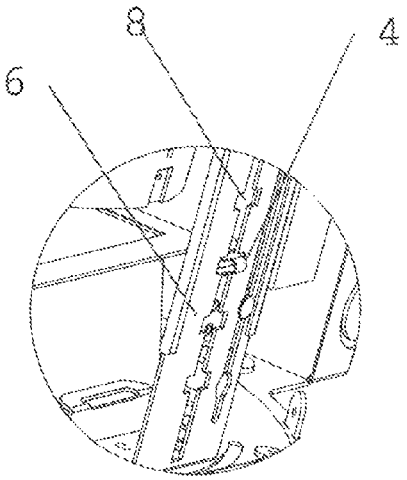
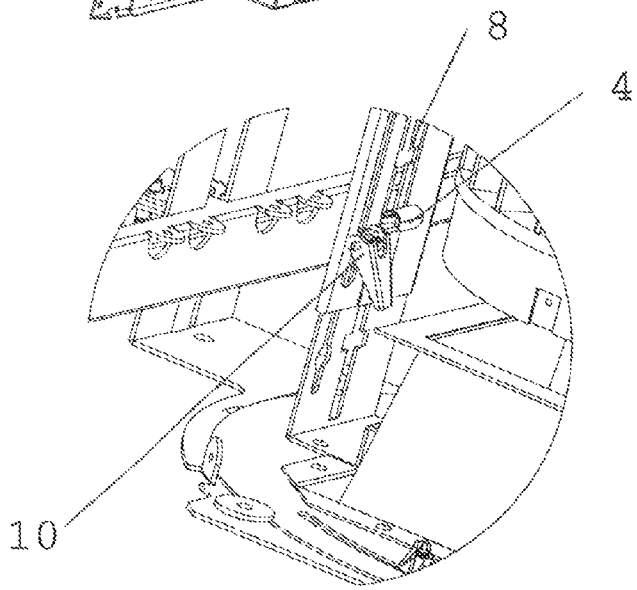
Fig. 20C

FIG 33A
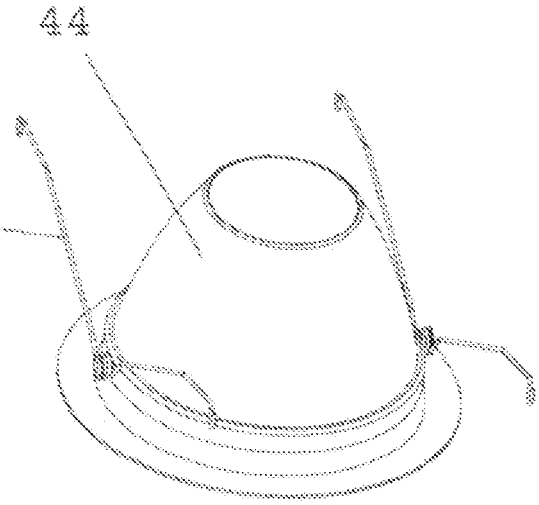
FIG 33B
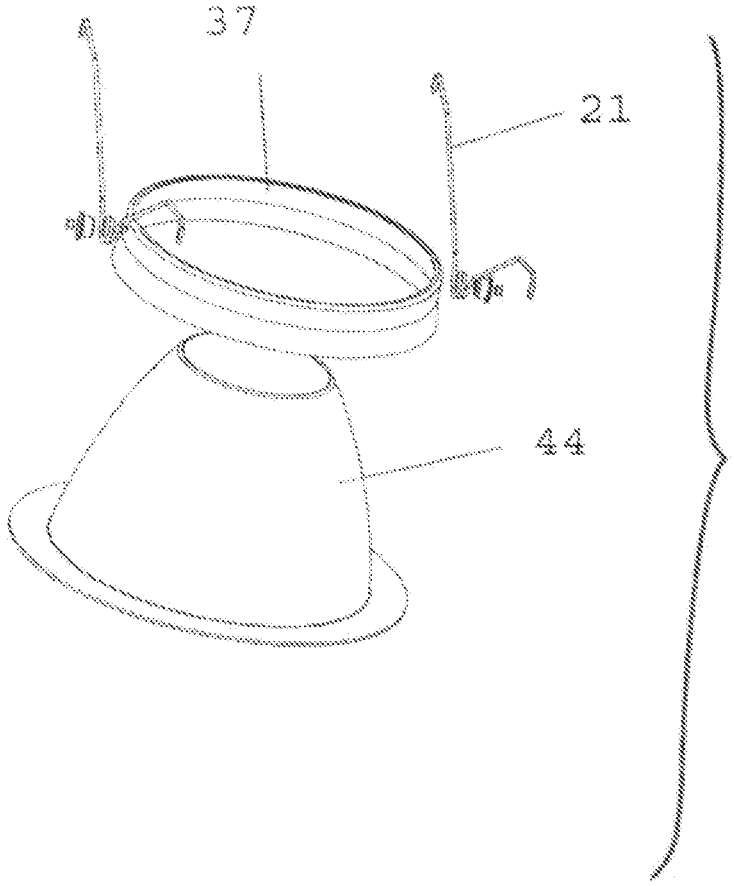
FIG 33

FIG. 34A
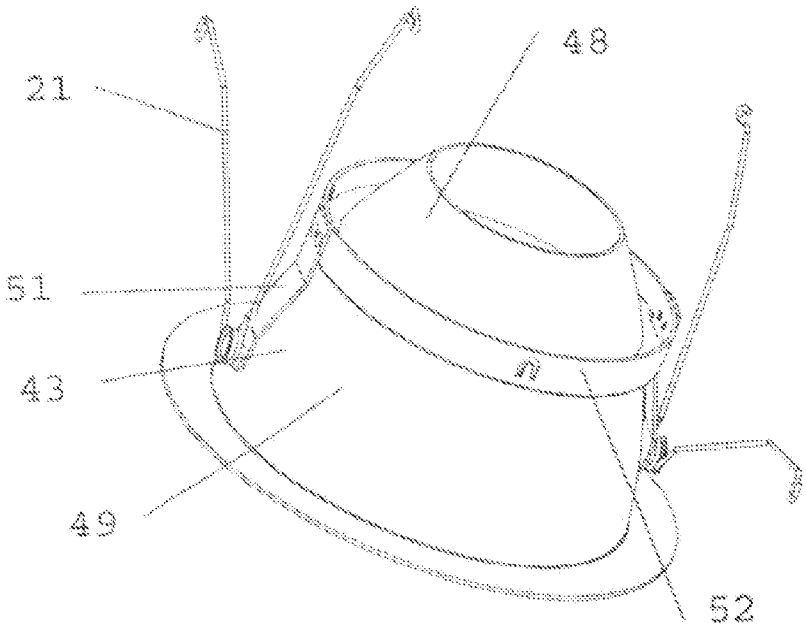
FIG. 34B
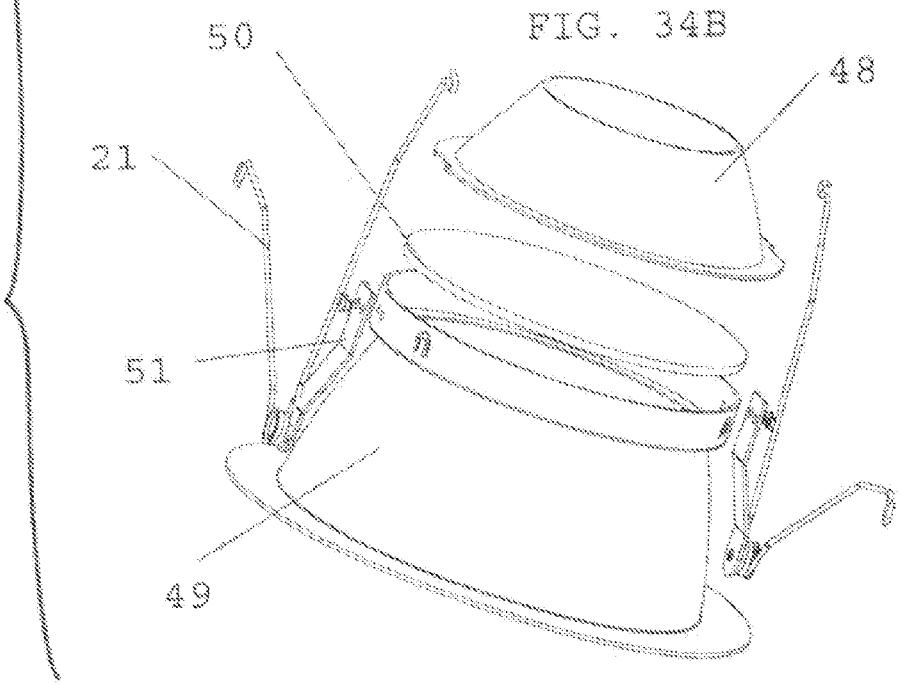
FIG 34

ADJUSTABLE RECESSED LIGHT FIXTURE

BACKGROUND SECTION OF THE INVENTION

Recessed light fixtures, which are installed in a ceiling, are becoming ever more popular.

A problem with recessed light fixtures particularly when used with an LED (Light Emitting Diode) light source is that users often seek different configurations based on the amount and type of lighting required. For example a user may want different types and sizes of reflectors to be used. A user has to use different recessed fixture for each particular type and size of a reflector.

A second problem with recessed lights is that they are difficult to align in the ceiling, particularly when a square aperture is used. The ceiling structure may not allow for installation of the recessed light at a desirable angle. Installing a recessed fixture at a particular angle can also be cumbersome.

A third problem with recessed lights is that they may provide limited access to a junction box.

There is a need in the art for an adjustable recessed light fixture for use with an LED light source that solves the foregoing problems.

SUMMARY SECTION OF THE INVENTION

Provided is a recessed light fixture comprising: a) a first bracket with a longitudinal section and two arms, each arm on opposite sides of the longitudinal section; b) a main frame having an aperture for passage of light from an LED (light emitting diode) light source, said aperture in parallel with the longitudinal section of the first bracket; c) a second bracket comprised of two arms with each arm attached to the main frame on opposite sides of the aperture; d) an LED light source in between the aperture and the longitudinal section; wherein the arms of the first bracket and the second bracket can be adjustably and detachably attached to each other to obtain a light fixture where distance between the longitudinal section of the first bracket and the aperture of the main frame can be adjusted. The first or the second bracket can have a plurality of holes located at predetermined locations along the bracket, and the first or the second bracket lacking the holes has a member for reversibly fitting into the holes. The member can be a clip. Both the first and the second bracket arms can have a path that overlap when the first and second bracket are placed against each other, allowing the distance to be adjusted at any location in the path. A screw with a lockable knob can slide along the path, allowing for locking of the knob at any location along the path. A heat sink can be attached to the longitudinal section of the first bracket facing the aperture. The heat sink can be rotatably attached to the first bracket. The heat sink can be held in place with a lock attached to the first bracket engaging a member attached to the heat sink. The fixture can further comprise one, two or three reflectors in between the heat sink and the aperture. The fixture can further comprise hangers and a junction box attached to the main frame. The fixture can further comprise a second frame in the aperture. The fixture can further comprise a third bracket on opposite sides of the main frame on sides of the aperture that the second bracket is not attached, with the third bracket extending into the aperture and having a semi-enclosed space for holding springs attached to a reflector. The fixture can further comprise attaching a third bracket on opposite sides of the main frame in between the aperture and arms of the second bracket, with the third bracket extending into the aperture and having a semi-enclosed space for holding springs attached to a reflector. The fixture can further comprise a disc with a square aperture placed on the main frame inside the fixture facing the first bracket, the disc capable of rotating in relation to the main frame, wherein the rotation of the disc allows for alignment of the square aperture of the disc.

Provided is a recessed light fixture comprising: a) a first bracket with a longitudinal section and two arms, each arm on opposite sides of the longitudinal section; b) a main frame having an aperture for passage of light from an LED (light emitting diode) light source, said aperture in parallel with the longitudinal section of the first bracket; c) a disc having a square aperture that is rotatably attached to the main frame inside the fixture facing the first bracket; d) a second bracket comprised of two arms with each arm attached on opposite sides of the square aperture of the disc; e) an LED light source in between the aperture and the longitudinal section; wherein the square aperture can be aligned to a desired angle by rotating the disc against the main frame. The fixture can further comprise attaching a plurality of holders to periphery of the main frame inside the fixture to hold the rotating disk. The rotating disc can have a path through which a screw attached to the main frame slides. The disc can be fixed to the main frame by putting a nut on the screw. One of the first or second bracket can have a plurality of holes located at predetermined locations along the bracket, and the first or the second bracket lacking the holes has a member for reversibly fitting into the holes. The member can be a clip. Both the first and the second bracket arms can have a path that overlap when the first and second bracket are placed against each other, allowing the distance to be adjusted at any location in the path. The screw can have a lockable knob that slides along the path, allowing for locking of the knob at any location. A heat sink can be attached to the longitudinal section of the first bracket facing the aperture. The heat sink can be held in place with a lock attached to the first bracket engaging a member attached to the heat sink with a lock attached to the first bracket engaging a member attached to the heat sink. One, two or three reflectors can be placed in between the heat sink and the aperture. Hangers and a junction box can be attached to the main frame. The fixture can further comprise attaching a third bracket on opposite sides of the main frame in between the aperture and arms of the second bracket, with the third bracket extending into the aperture and having a semi-enclosed space for holding springs attached to a reflector. The fixture can further comprise a third bracket on opposite sides of the main frame on sides of the aperture that the second bracket is not attached, with the third bracket extending into the aperture and having a semi-enclosed space for holding springs attached to a reflector.

BRIEF DESCRIPTION OF THE FIGURES

FIG. 10A illustrates a bottom perspective view of a light fixture of a first embodiment of the invention with an adjustment assembly.

FIG. 10B is a close up of the adjustment assembly facing inside the fixture.

FIG. 10C is a close up of the adjustment assembly facing away from the fixture.

FIG. 20A illustrates a bottom perspective view of a light fixture of a second embodiment of the invention with an adjustment assembly and a rotating disc.

FIG. 20B is a close up of the adjustment assembly facing inside the fixture of a second embodiment of the invention with an adjustment assembly and a rotating disc.

FIG. 20C is a close up of the adjustment assembly facing away from the fixture of a second embodiment of the invention with an adjustment assembly and a rotating disc.

FIG. 33A illustrates a top perspective view of a round six inch reflector.

FIG. 33B illustrates a top perspective and exploded view of a round six inch reflector.

FIG. 34A illustrates a top perspective view of a round 6 inch reflector comprised of two reflectors.

FIG. 34B illustrates a top perspective and exploded view of a round 6 inch reflector comprised of two reflectors.

DETAILED DESCRIPTION OF THE INVENTION

The present invention provides an adjustable recessed light fixture that can be used with a variety and a plurality of reflectors and heat sinks. This adjustable light fixture allows a user to buy a single type of fixture and adjust the fixture as needed based on the number and type of reflectors and/or heat sinks that are used.

Figure 1:
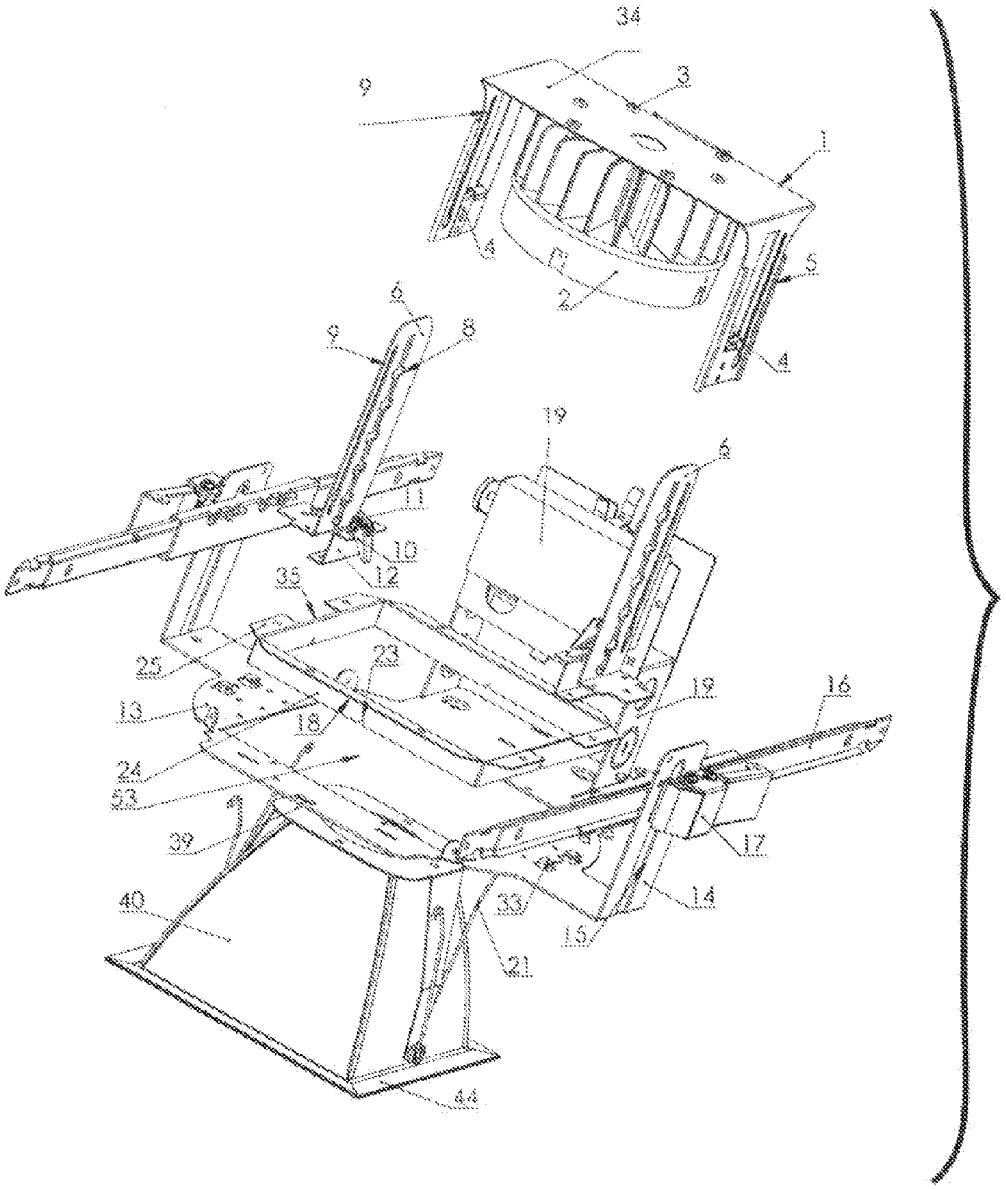
FIG. 1 illustrates a perspective and exploded view of a light fixture of a first embodiment of the invention with an adjustment assembly.
Figure 2:
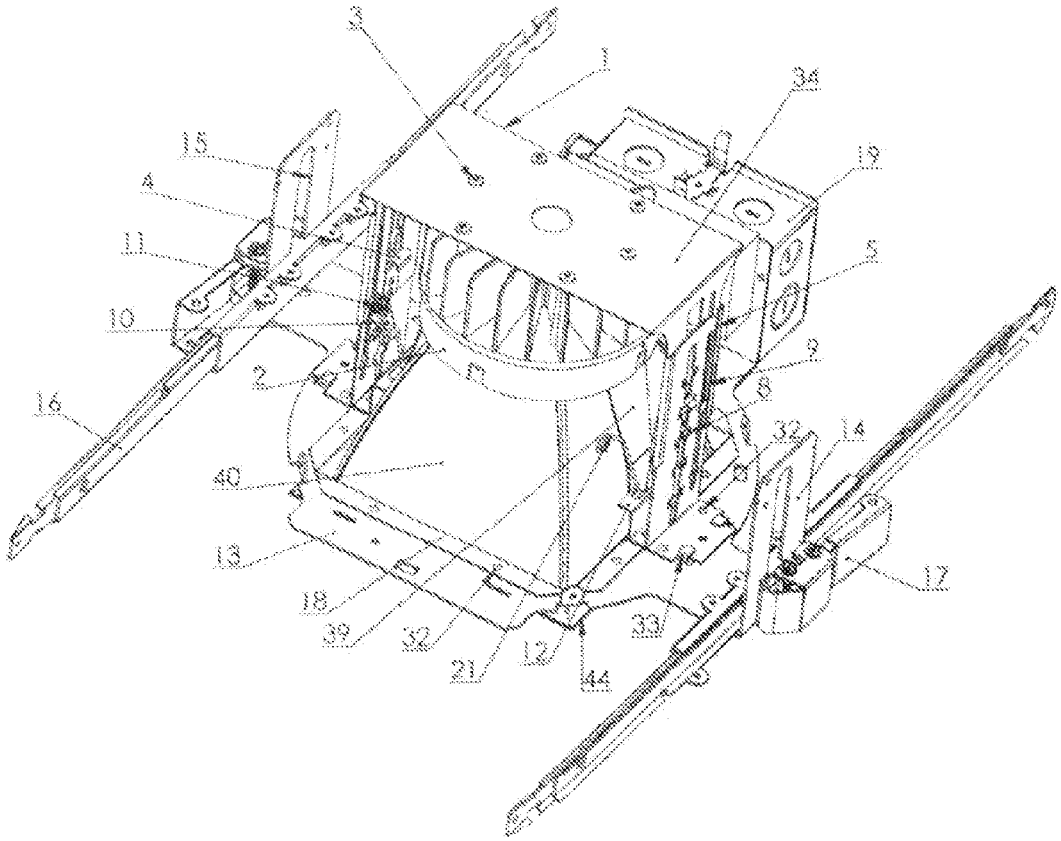
FIG. 2 illustrates a perspective view of a light fixture of a first embodiment of the invention with an adjustment assembly.

FIGS. 1 and 2 illustrate an adjustable recessed light fixture. FIG. 1 is an exploded view of the fixture in FIG. 2.

The fixture of FIGS. 1 and 2 has a first bracket (1) for adjustably and detachably attaching to a second bracket (6). The second bracket (6) is attached to a main frame (13), such as with rivets (32) or bracket holders (33). It is also possible to make the main frame (13) as a one piece material having the second bracket (6). The first bracket (1) and the second bracket (6) can align, move or slide against each other to obtain the optimum height desired by a user for a particular size and combination of reflectors.

The first bracket (1) can be a U-shaped bracket with arms (5) that can be positioned on opposite sides of a horizontal portion (34) of the bracket. The arms (5) of the bracket align, slide or move against the second bracket (6). The bracket arms (5) have a clip (4) that can snap into clip holes (8) on the second bracket (6). The first bracket arms (5) and the second bracket can each have an overlapping path (9) for travel by a locking knob (10). The locking knob (10) can be a nut with a handle on a screw (11) that travels through path (9) and allows for locking the first bracket (1) and the second bracket (6) at spaces in between the clip holes (8).

A heat sink (2) can be attached to the horizontal or top portion (34) of the first bracket (1). The heat sink (2) can be attached with screws (3). The length of the horizontal or top portion (34) of the first bracket (1) allows for attaching any heat sink (2) that fits within the first bracket (1), yet another way that the fixture allows for adjustment based on a particular need by a user.

The second bracket (6) is comprised of two arms on opposite sides of the aperture (53) of the main frame (13). Rivets (32) and/or bracket holders (33) can be used to join the arms of the second bracket (6) to the main frame (13).

The main frame (13) can have a third bracket (12) on opposite sides of the frame aperture (53). The third bracket (12) can have a semi-enclosed space (20) for maintaining a torsion spring (21) of the reflector (22). FIGS. 1 and 2 illustrate a main frame (13) with a square aperture (53). A round aperture can also be used if needed. A square frame (18) is placed inside the main frame, with the trim (24) of the square frame (18) extending downward and away from the first bracket (1). The trim (24) of the square frame (18) can have an alignment gap (23) for passing through laser light. The square frame (18) can have one or more flanges (25) for attachment to the main frame (13).

The flange of the square frame (18) can have gaps (35) for placement of the third bracket (12). The third bracket (12) extends inward resulting in the semi-enclosed space (20) extending inside of main frame aperture (53) despite attachment on the main frame (13). The semi-enclosed space (20) holds torsion spring (21) in place when the reflector (22) is placed inside the fixture.

Main frame (13) can have arms (14) with a sliding path (15) on opposite sides for attachment to a ceiling. The arm (14) can have a sliding path (15) that allows for adjustable attachment to lock (16) of hangers. The hangers (16) are then used to hang the fixture in a recessed position in the ceiling.

Reflector (40), which is a 6 inch reflector, is shown with a torsion spring holder (39). The torsion spring holder (39) has a horizontal portion with a round aperture and two arms. The round aperture sits on top of the reflector (40) opening and sits on top of the LED holder that is in heat sink (2). The two arms of the spring holder (39) run on opposite sides of the reflector (40) and are attached to a location on the reflector (40) that is substantially in the widest region of the reflector (farthest point from the heat sink (2)).

Reflector (40) is not attached to the arms (14) of the main frame (13). This independence allows for using the arms (14) to adjust the position of the fixture and using reflectors of different sizes.

In FIG. 2, the height of the fixture has been adjusted through the first bracket (1) and the second bracket (6), and the clip (4) is in a clip hole (8). The reflector (40) has been placed inside the fixture in FIG. 2.

Figure 3:
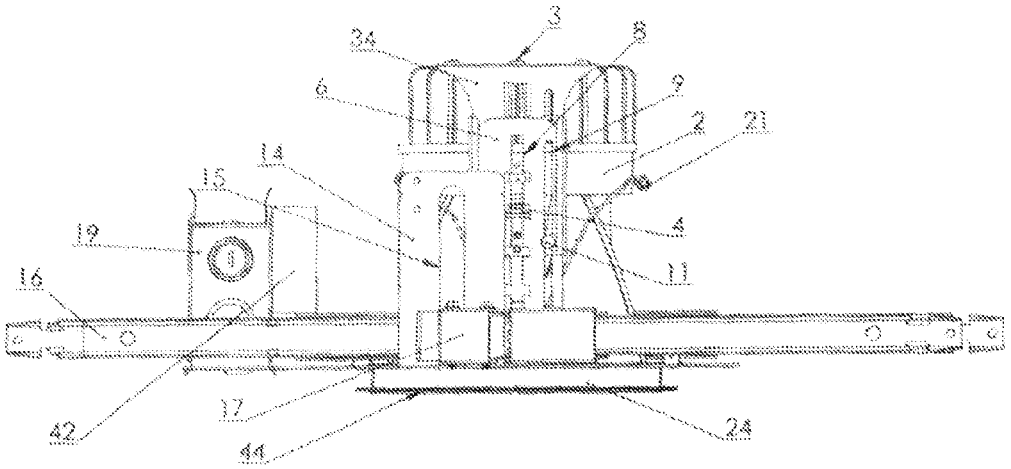
FIG. 3 illustrates a side view of a light fixture of a first embodiment of the invention with an adjustment assembly.
Figure 4:
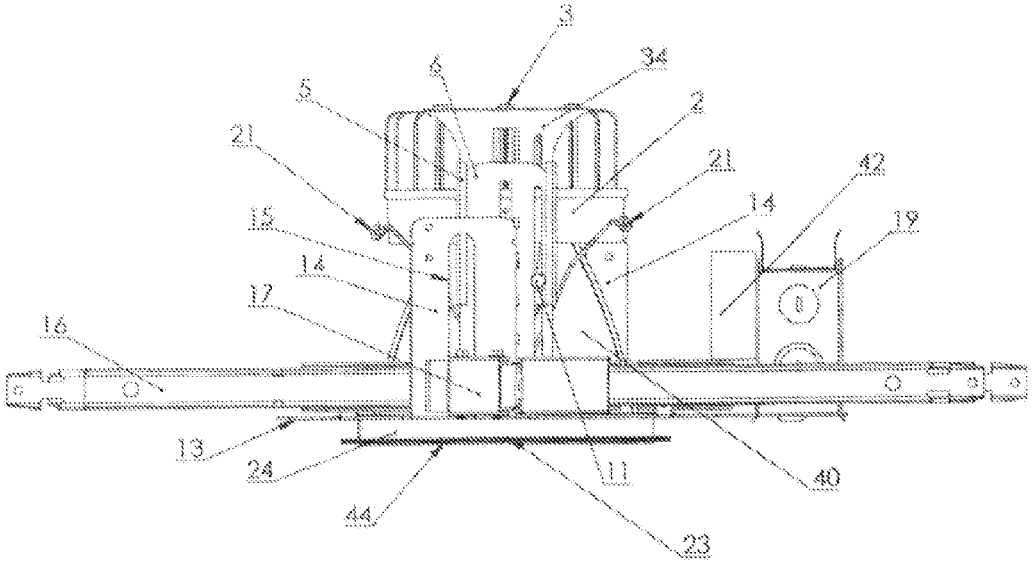
FIG. 4 illustrates a side view of a light fixture of a first embodiment of the invention with an adjustment assembly.

FIG. 3 illustrates a first side view of the fixture of FIG. 2 with the reflector in place. In this view, the hanger (16) is in front (perpendicular to view) and attached to the bottom of sliding path (15) of the arm (14) of the main frame (13). The junction box (19) is shown to the left. Clip (4) of the first bracket (1) is in clip hole (8) of the second bracket (6). The heat sink (2) is attached to the top (34) of the first bracket (1). FIG. 4 is another side view of the same fixture of FIG. 3 (after a 180 degree rotation).

Figure 5:
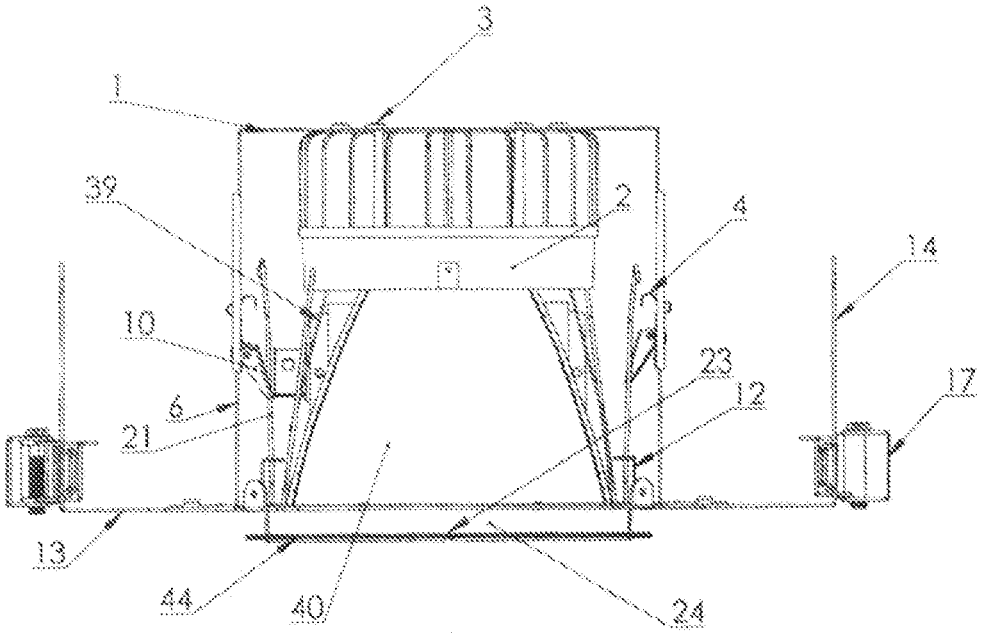
FIG. 5 illustrates a side view of a light fixture of a first embodiment of the invention with an adjustment assembly.
Figure 6:
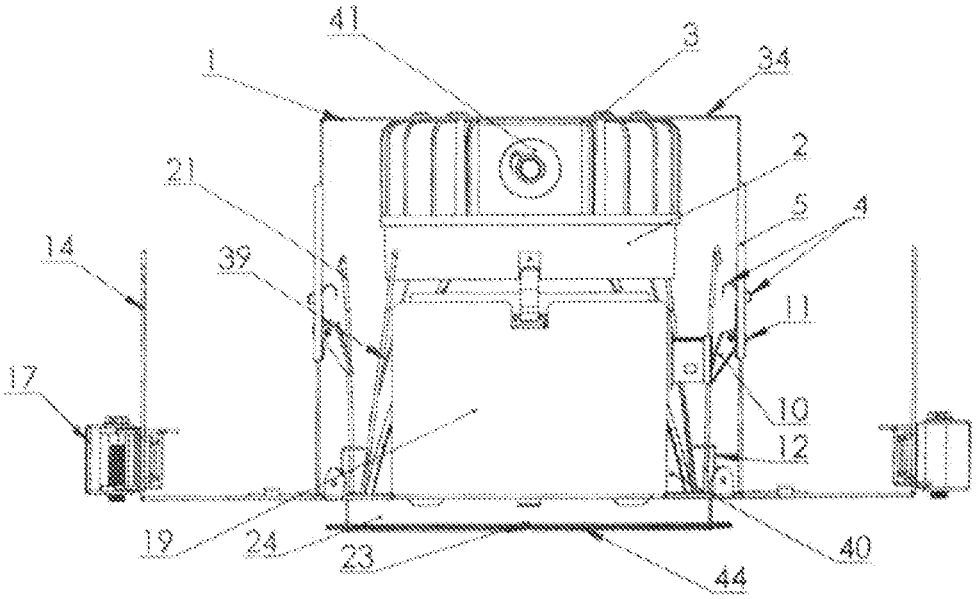
FIG. 6 illustrates a side view of a light fixture of a first embodiment of the invention with an adjustment assembly.

FIGS. 5 and 6 are side views of the fixture perpendicular in direction to an axis from one arm (14) to the other arm of the main frame (13). FIG. 5 illustrates that the height of the fixture has been adjusted through the first bracket (1) and the second bracket (6), and the clip (4) is in a clip hole (8). The fixture is shown with a heat sink (2) and a convex shaped reflector (40) that is attached to the heat sink (2). Also illustrated is torsion spring (21) being held in place with the third bracket (12). The junction box (19) is behind the reflector (40) in this view. FIG. 6 is another side view, where the view of FIG. 5 is rotated 180 degrees. The junction box (19) is in front in this view. The heat sink (2) is shown with a flex connector (41) where a conduit containing wires from the junction box enters the heat sink (2) and powers the LED light source.

Figure 7:
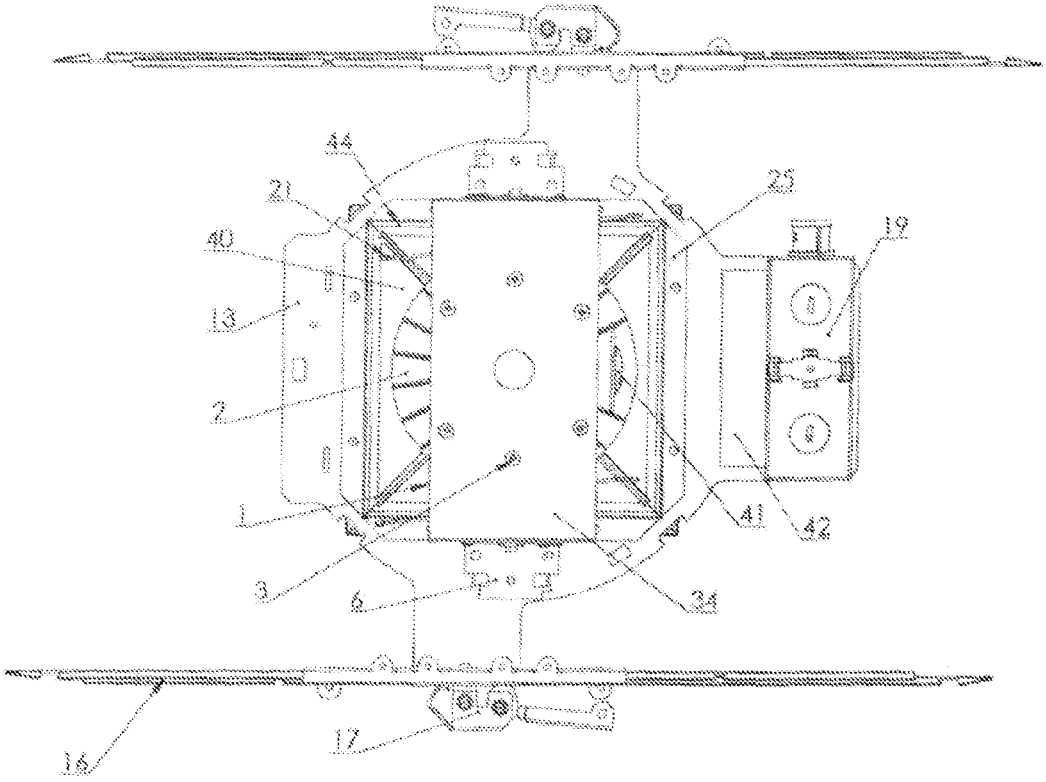
FIG. 7 illustrates a top view of a light fixture of a first embodiment of the invention with an adjustment assembly.

FIG. 7 illustrates a top view of the fixture. Screws (3) of the first bracket (1) hold the heat sink (2). The reflector (22) is below the heat sink. The Junction box (19) is on the right side. Also shown are the main frame (13) and the hangers (16).

Figure 8:
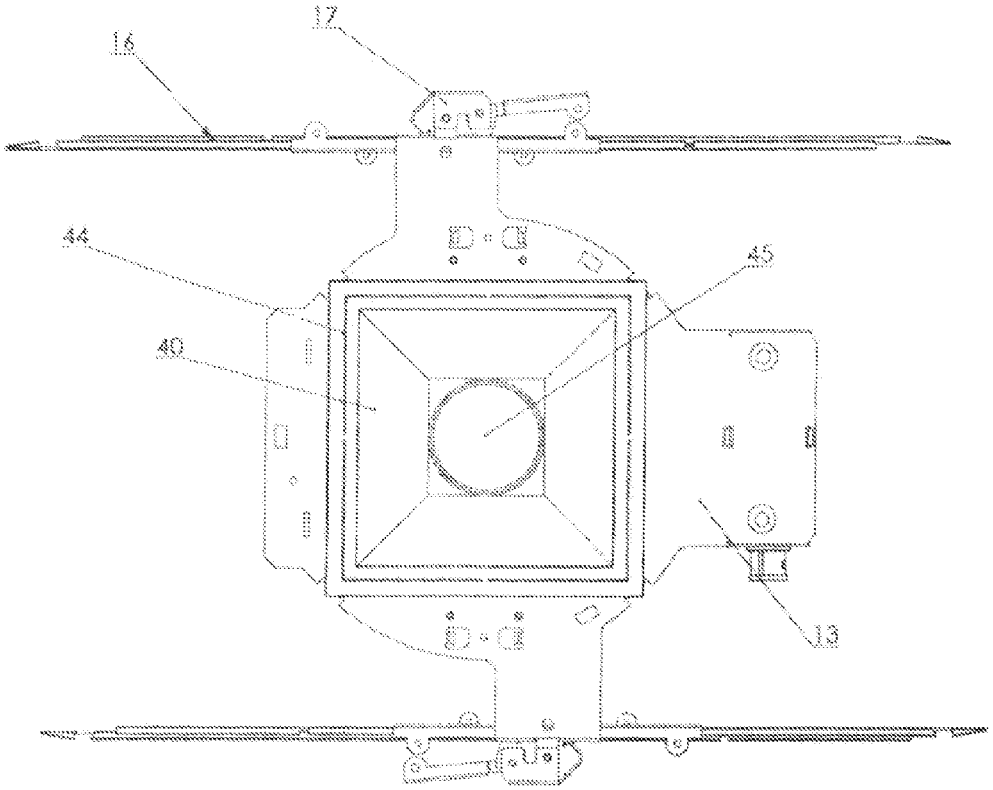
FIG. 8 illustrates a bottom view of a light fixture of a first embodiment of the invention with an adjustment assembly.

FIG. 8 illustrates a bottom view of the fixture. Inside (23) of a square shaped reflector (40) is shown. The round aperture view inside Reflector (40) is caused by the torsion spring holder (39) which touches the LED holder (46). An LED light source is behind reflector (40). The heat sink (2) is on top of the reflector. An optional glass can be placed in between the heat sink and the reflector.

Figure 9:
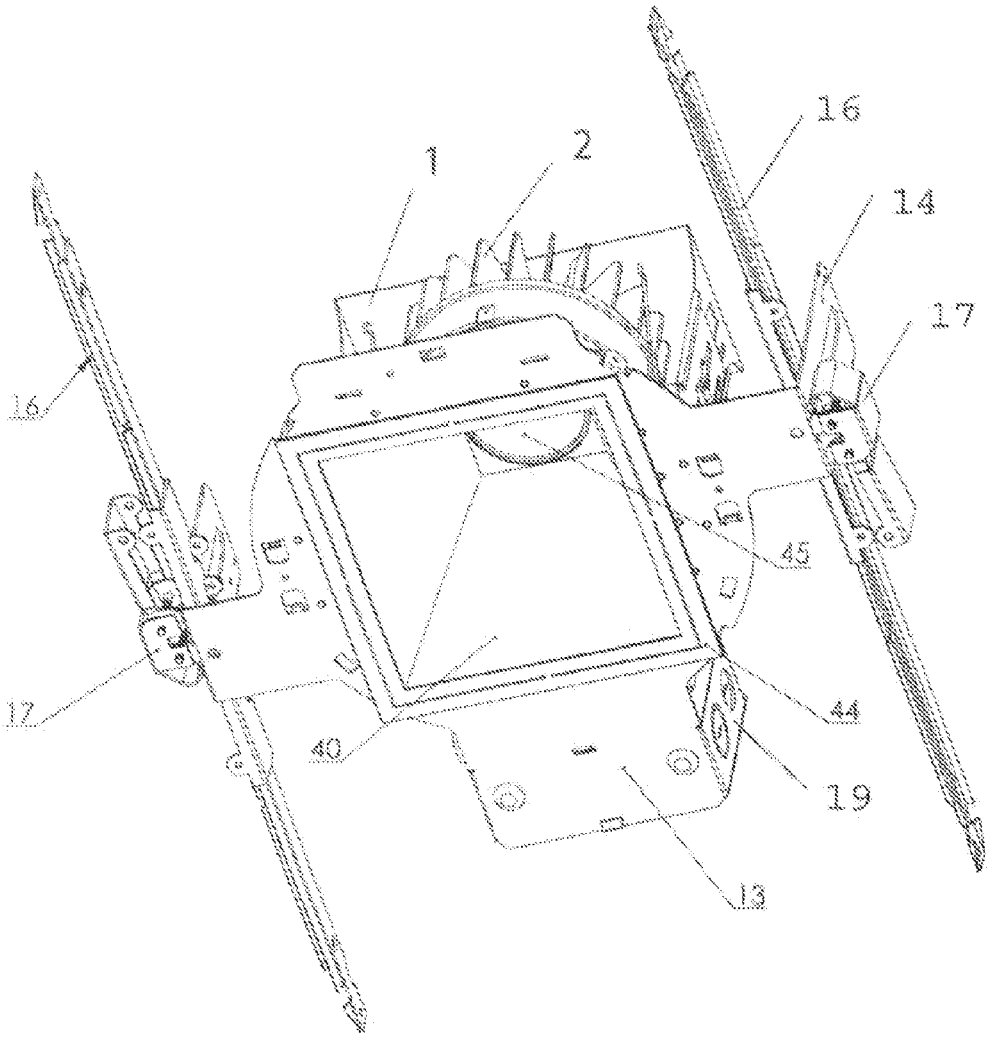
FIG. 9 illustrates a bottom perspective view of a light fixture of a first embodiment of the invention with an adjustment assembly.

FIG. 9 illustrates a bottom perspective view of the fixture of FIG. 2 with the reflector (22) in place. The hangers (16) are connected to the main frame (13). The heat sink (2) is attached to the first bracket (1).

FIGS. 10A, 10B, and 10C illustrate the adjustment assembly of first bracket (1) and second bracket (6) in detail. FIG. 10C illustrates the assembly of bracket arm (5) with clip (4) in a clip hole (8). The clip (4) stabilizes and maintains the first bracket (1) and second bracket (6) together. The clip (4) can extend out inside the second bracket (6) to allow for manipulation by the finger (curve design for accepting finger). If it is desired to stabilize the first bracket (1) and the second bracket (2) at a space between the plurality of clip holes (8), the locking knob (10) Can be used.

Figure 11:
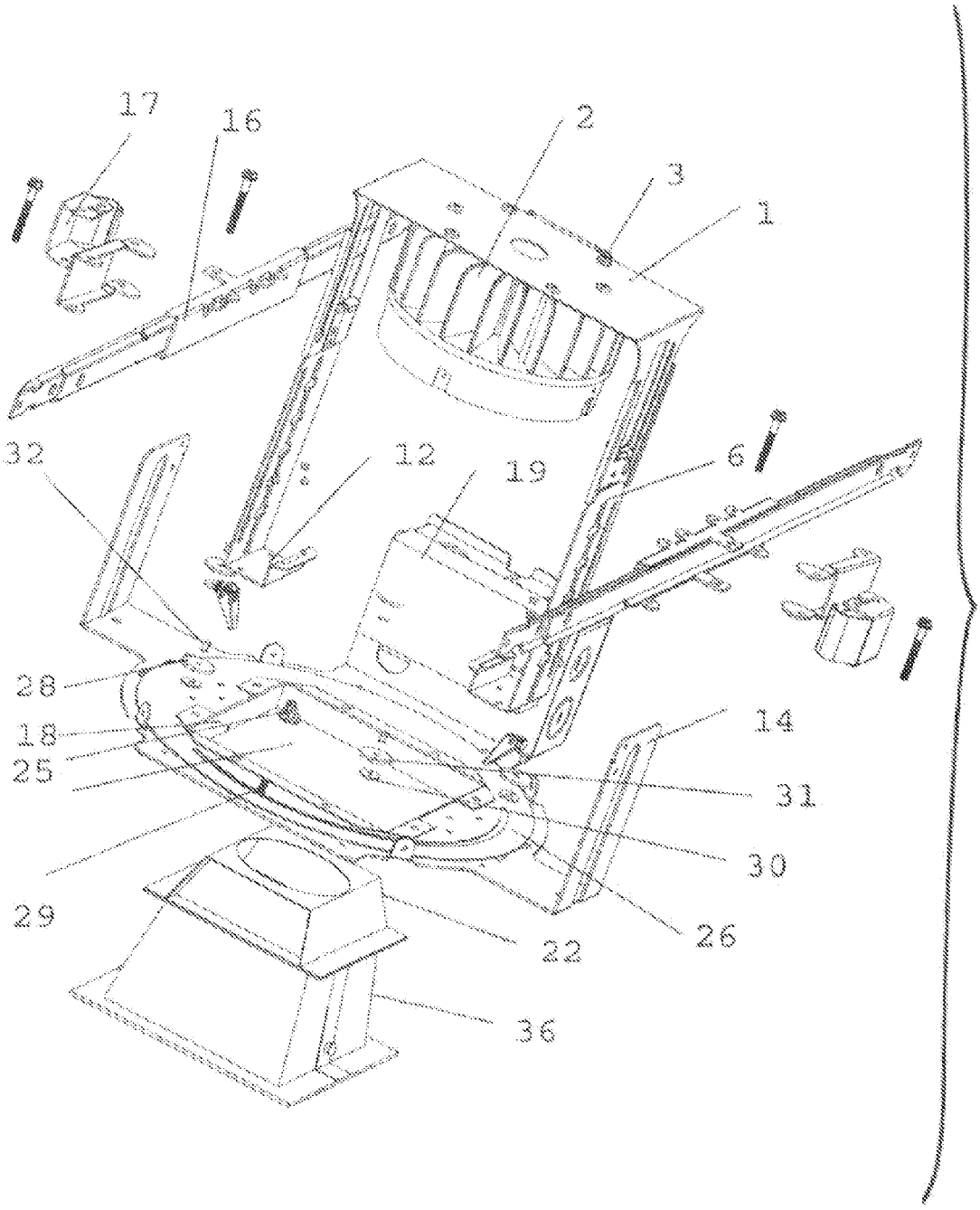
FIG. 11 illustrates a perspective and exploded view of a light fixture of a second embodiment of the invention with an adjustment assembly and a rotating disc.
Figure 12:
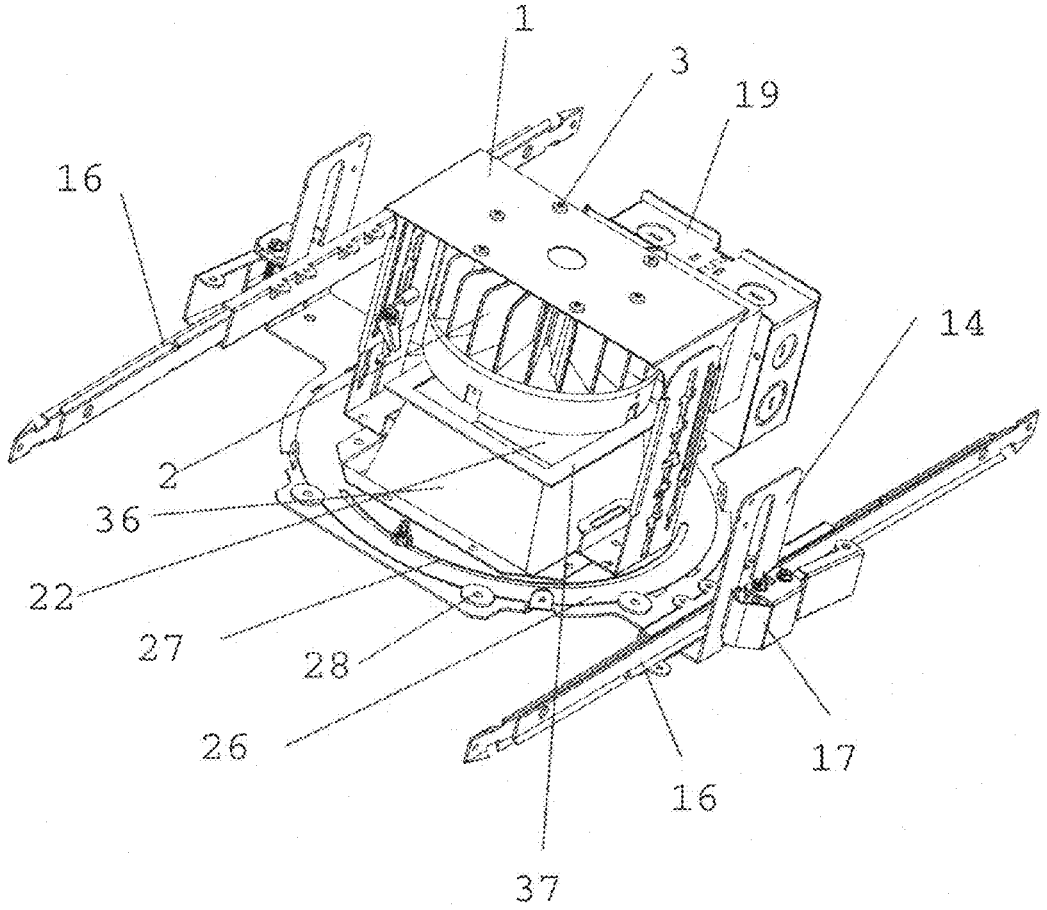
FIG. 12 illustrates a perspective view of a light fixture of a second embodiment of the invention with an adjustment assembly and a rotating disc.

FIGS. 11 and 12 illustrate an embodiment of the fixture of FIG. 1 where the reflector(s) (22, 36) can be rotated. This design is useful in aligning of the square reflector(s) (22, 36) and any trim (24) to a desirable alignment. A single six inch (40) or other size reflector can also be used. The structure of a ceiling may not allow installing a fixture at a desired angle. This fixture can be rotated to obtain the desired angle seen by a user despite the actual orientation of the fixture in a ceiling.

In FIG. 11 the reflectors (22, 36) are outside of the fixture and in FIG. 12 the reflectors (22, 36) are in place in the fixture. When having a square reflector (22), the rotation allows for aligning the reflector (22) even if the position of the lighting fixture in the ceiling is not suitable. Ability to rotate at least about 90 degrees, such as about 100 degrees is desirable with a square trim. In the embodiment, a disc is rotatably attached to the main frame (13). Holders (28) can hold disc (26) while at the same time allowing disc (26) to rotate. The holder (28) can be made of a first a first washer (30) and a second washer (31) that are held together by a rivet (32) or a screw. The first washer (30) has a smaller diameter than the second washer (31), which allows the disc (26) to slide under the second washer (31) while confined by the first washer (30). The disc (26) has a path (27) for screw (29) which is attached to nut (25) to slide through. The nut can be tightened at a desired location. In this embodiment, the second bracket (6) (and the first bracket (1) through connection to the second bracket (6)), the third bracket (12), and the square frame (18) are all attached to the rotating disc (26). The rotation of disc (26) results in simultaneous rotation of the second bracket (6), the first bracket (1), the third bracket (12), the square frame (18), the heat sink (2), and reflector(s) (22, 36). In this embodiment, the junction box (19), the main frame (13) and the hangers (16) do not rotate with the rotating disc (26).

FIGS. 11 and 12 are illustrated with a two reflectors which are attached to a heat sink (2). A first square reflector (22) is placed on a second square reflector (36). A lens (not visible in this figure but is below trim (37)) can be placed in between the first square reflector (22) and the second square reflector (36). The second reflector (36) as shown in FIG. 11 has a round opening that sits on the bottom of heat sink (2) and allows for passage of light from an LED source placed in heat sink (2). The shape and height of reflector (22, 36), and the presence and type of trim (37) used can be carried by a user to obtain any desirable lighting effect. In this embodiment as illustrated, the reflectors (22, 36) together form a 4 inch reflector.

Figure 13:
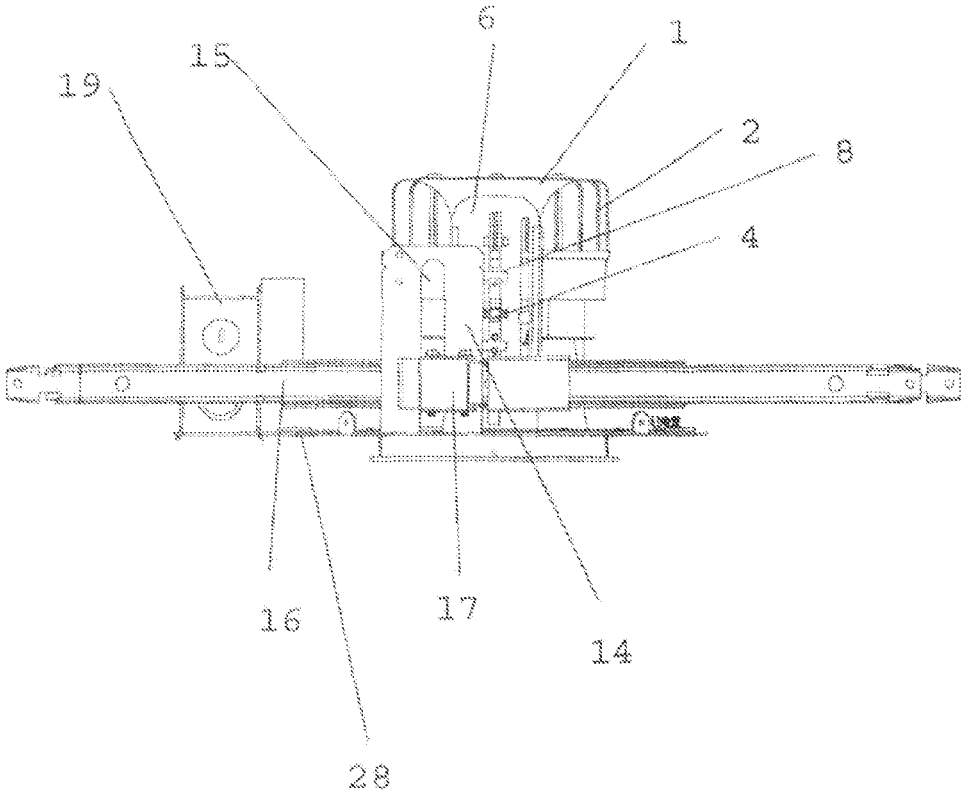
FIG. 13 illustrates a side view of a light fixture of a second embodiment of the invention with an adjustment assembly and a rotating disc.
Figure 14:
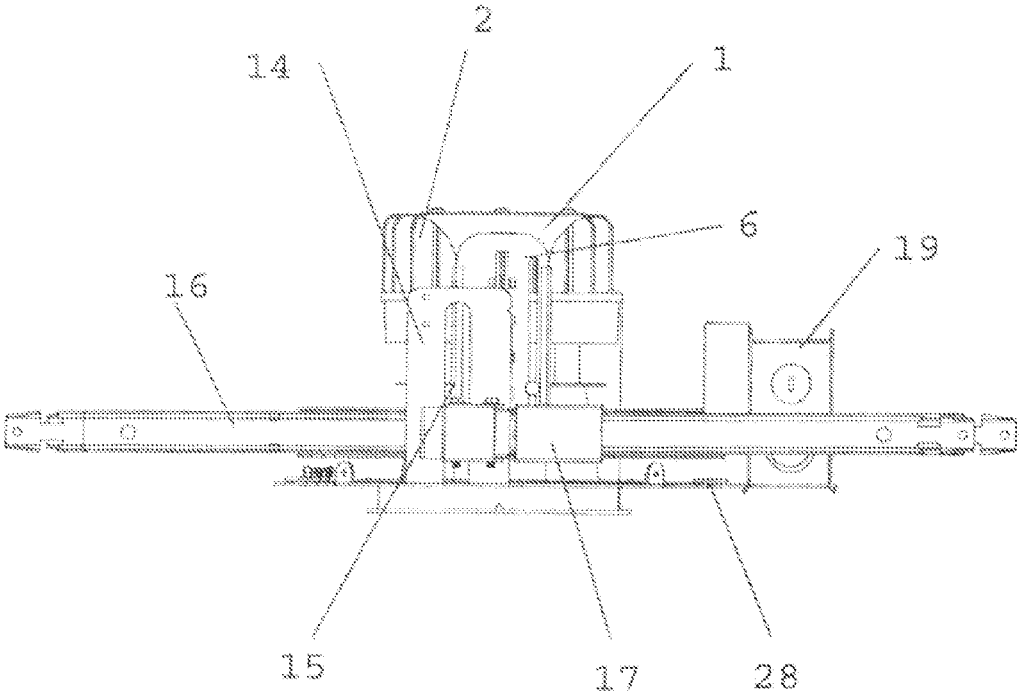
FIG. 14 illustrates a side view of a light fixture of a second embodiment of the invention with an adjustment assembly and a rotating disc.

FIG. 13 illustrates a first side view of the fixture of FIG. 12 with reflectors (22) and (36) in place. In this view, the hanger (16) is in front and attached to the bottom of sliding path (15) of the main frame (13). The junction box (19) is shown to the left. Clip (4) of the first bracket (1) is in clip hole (8) of the second bracket (6). The heat sink is attached to the top of the first bracket (1). FIG. 14 is another side view of the same fixture of FIG. 13 (after a 180 degree rotation). In both FIGS. 13 and 14, the holders 28 are shown inside the fixture holding disc (26).

Figure 15:
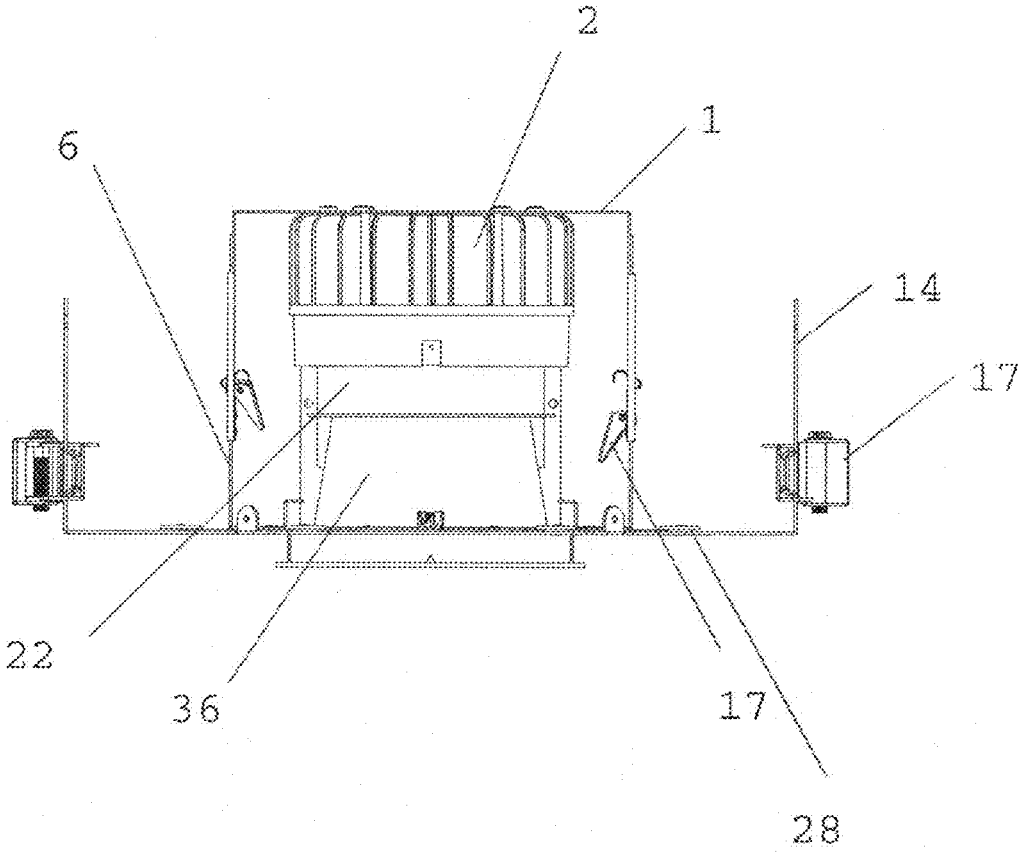
FIG. 15 illustrates a side view of a light fixture of a second embodiment of the invention with an adjustment assembly and a rotating disc.
Figure 16:
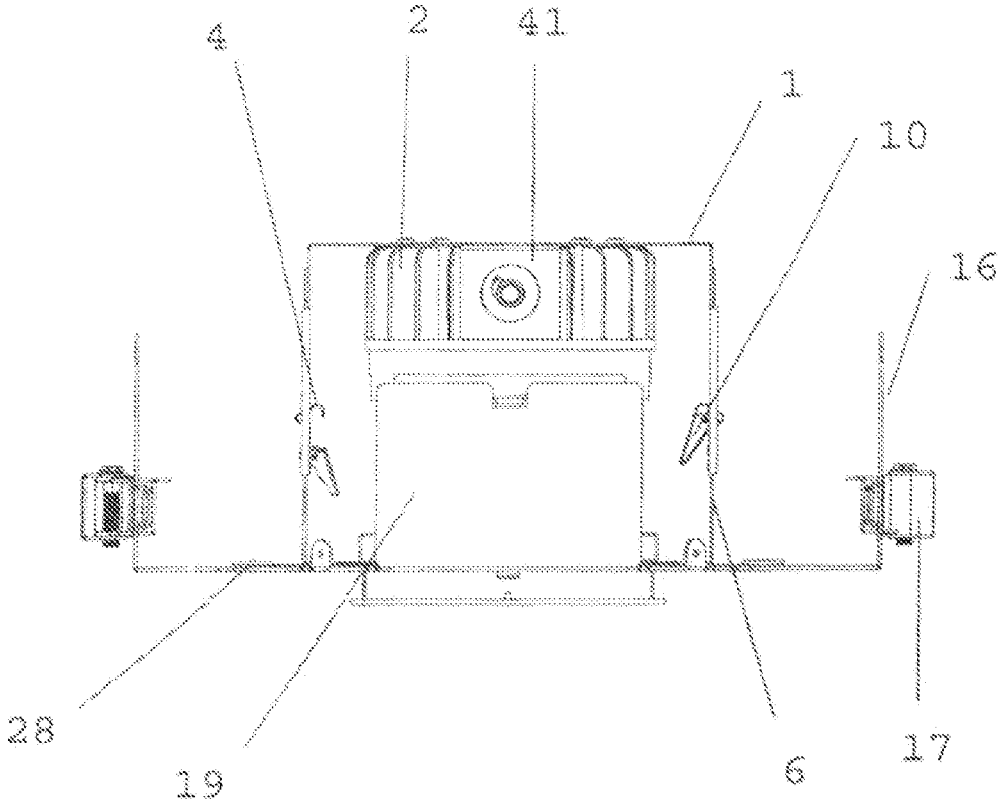
FIG. 16 illustrates a side view of a light fixture of a second embodiment of the invention with an adjustment assembly and a rotating disc.

FIGS. 15 and 16 are side views of the fixture perpendicular in direction to an axis from one arm (14) to other of the main frame (13). FIG. 15 illustrates that the height of the fixture has been adjusted through the first bracket (1) and the second bracket (6), and the clip (4) is in a clip hole (8) (not shown). The fixture is shown with a heat sink (2) and reflector (22) resting on top of reflector (36). Reflector (36) is below reflector (22) which itself is below the heat sink (2). The junction box (19) is behind the reflector (22) and (36) in this view. FIG. 16 is another side view, where the view of FIG. 15 is rotated 180 degrees. The junction box (19) is in front in this view.

Figure 17:
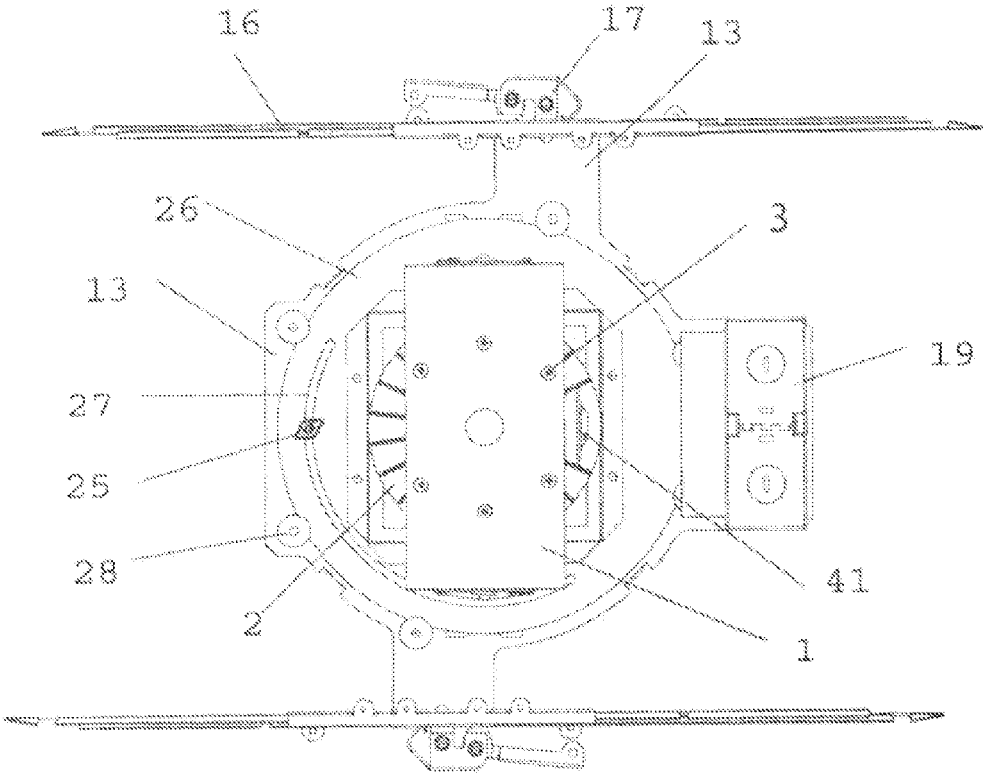
FIG. 17 illustrates a top view of a light fixture of a second embodiment of the invention with an adjustment assembly and a rotating disc.

FIG. 17 illustrates a top view of the fixture. Screws (3) of the first bracket (1) hold the heat sink (2). The Junction box (19) is on the right side. Also shown are the main frame (13) and the hangers (16). The rotating disc (26) is being held in place by a plurality of holders (28). The rotating disc (26) has a path (27) for screw (29) attached to nut (25) to slide through. The nut (25) can be tightened at the desired location.

Figure 18:
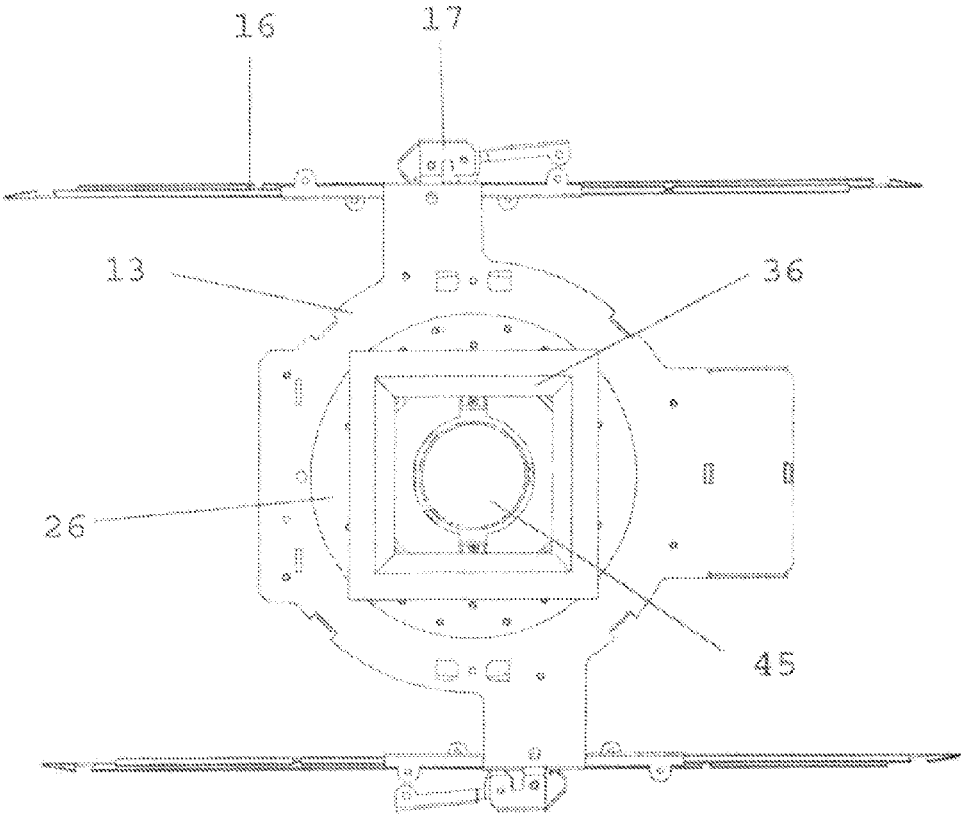
FIG. 18 illustrates a bottom view of a light fixture of a second embodiment of the invention with an adjustment assembly and a rotating disc.
Figure 19:
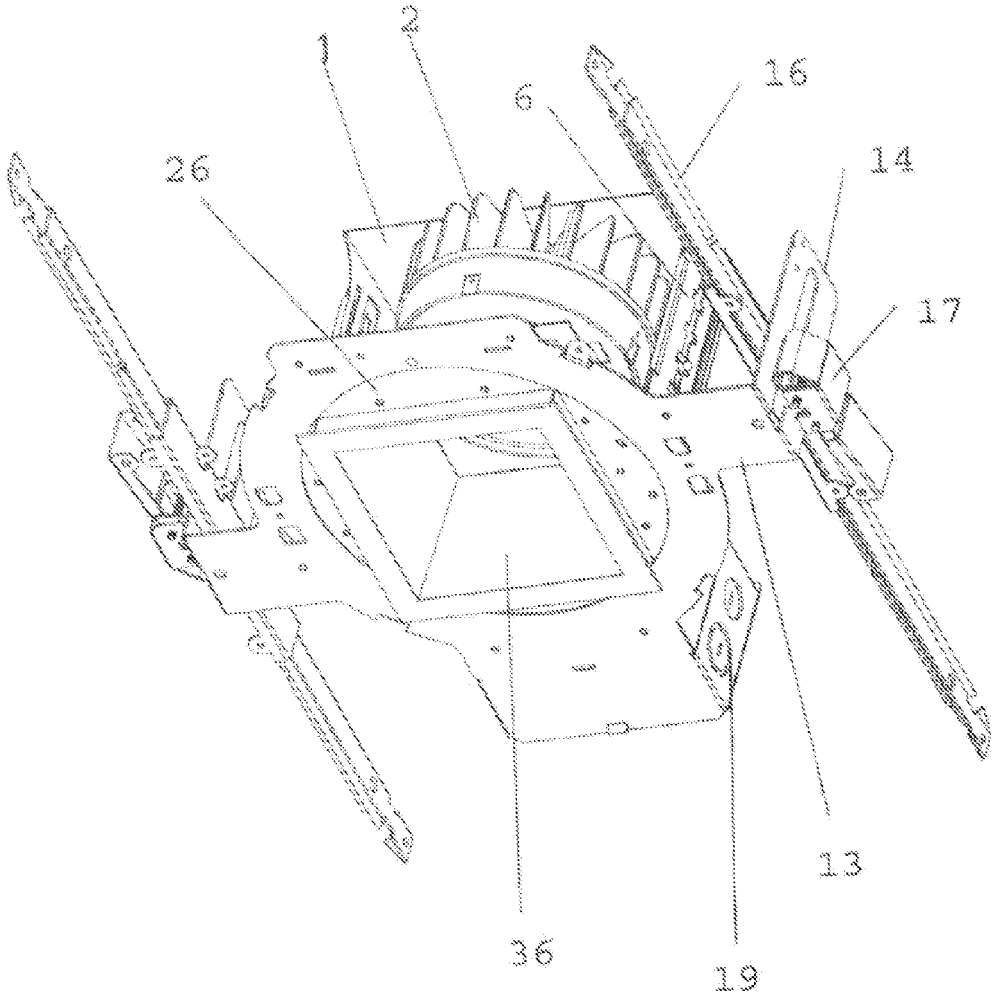
FIG. 19 illustrates a bottom perspective view of a light fixture of a second embodiment of the invention with an adjustment assembly and a rotating disc.

FIG. 18 illustrates a bottom view of the lighting fixture of FIGS. 11 and 12. This is essentially the same view as FIG. 8 with two reflectors (22, 36) in place. Because the holders (28) and the disc (26) are placed inside the fixture, the fixture looks the same as the one in FIG. 8 from this angle, giving a clean and elegant look the fixture when viewed from the floor. Illustrated is reflector (22) on bottom of reflector (36). The round aperture view inside Reflector (40) is caused by the torsion spring holder (39) which touches the LED holder (46). An LED light source is behind reflector (40). An optional lens can be placed in between the heat sink and the reflector, or between reflector (36) and reflector (22). If a full LED with a reflector and lens is used, an additional lens need not be placed after the full LED. FIG. 19 illustrates a bottom perspective view of the fixture of FIG. 18 with the reflector (22) and (36) in place (inside the fixture). The hangers (16) are connected to the main frame (13).

FIGS. 20A, 20B, and 20C illustrate the adjustment assembly of first bracket (1) and second bracket (6) in detail. The clip (8) can extend out inside the second bracket (6) to allow for manipulation by the finger (curve design for accepting finger). FIG. 20C illustrates the assembly of bracket arm (5) with clip (4) in a clip hole (8). The clip (8) stabilizes and maintains the first bracket (1) and second bracket (6) together. If it is desired to stabilize the first bracket (1) and the second bracket (2) at a space between the plurality of clip holes (8), the locking knob (10 Can be used.

Figure 21:
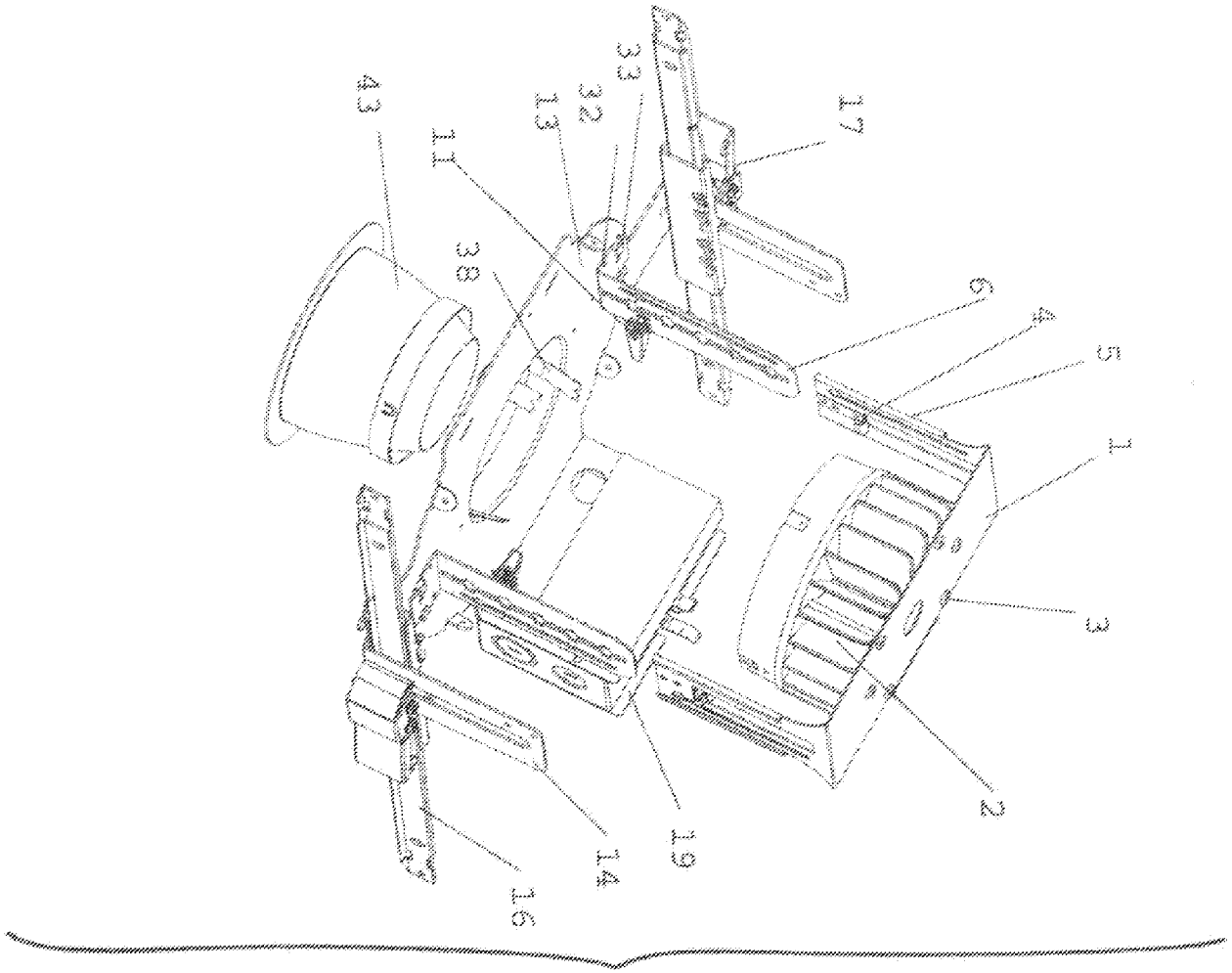
FIG. 21 illustrates a perspective and exploded view of a light fixture of a third embodiment of the invention with an adjustment assembly.
Figure 22:
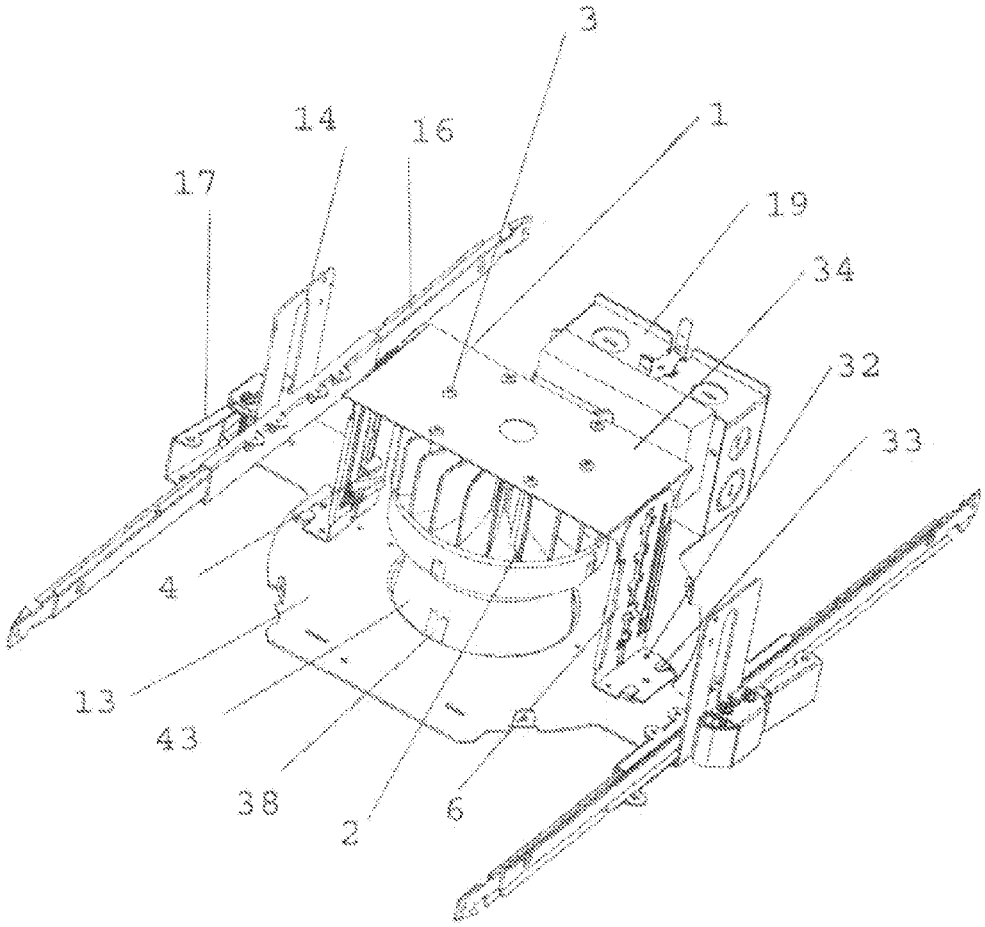
FIG. 22 illustrates a perspective view of a light fixture of a third embodiment of the invention with an adjustment assembly.

The fixture of FIGS. 21 and 22 has a first bracket (1) for adjustably and detachably attaching to a second bracket (6). The second bracket is attached to a frame (13), such as with rivets (32) or bracket holders (33). It is also possible to make the frame (13) as a one piece material having the second brackets (6). The first bracket (1) and the second bracket (6) can move or slide against each other to obtain the optimum height desired by a user for a particular size and combination of reflectors.

The first bracket (1) can be a U-shaped bracket with arms (5) which can be positioned on opposite sides of a horizontal portion (34) of the bracket. The arms (5) of the bracket slide or move against the second bracket (6). The bracket arms (5) have a clip (4) which can snap into clip holes (8) on the second bracket (6). The first bracket arms (5) and the second bracket can each have an overlapping path (9) for travel by a locking knob (11). The locking knob (11) is a nut with a handle on a screw (11) which travels through path (9) and allows for locking the first bracket (1) and the second bracket (6) at spaces in between the clip holes (8).

A heat sink (2) can be attached to the horizontal or top portion (34) of the first bracket (1). The heat sink (2) can be attached with screws (3). The length of the horizontal or top portion (34) of the first bracket (1) allows for attaching any heat sink (2) that fits within the first bracket (1), yet another way that the fixture allows for adjustment based on a particular need by a user.

The second bracket (6) is comprised of two arms on opposite sides of the aperture (53) of the main frame (13). Rivets (32) and/or holders (33) can be used to join the arms of the second bracket (6) to the main frame (13).

In this embodiment, a third bracket (12) and a torsion spring (21) is not used. Rather, the reflector (43) is held in the fixture by clips (38) on the main frame (13). A square aperture (53) is also not needed at least when a round reflector (43) is used.

Main frame (13) can have sliding arms (14) on opposite sides for attachment to a ceiling. The sliding arm (14) can have a sliding path (15) that allows for adjustable attachment to lock (17) of hangers. The hangers (16) are then used to hang the fixture in a recessed position in the ceiling.

In this embodiment, the main frame (13) has a trim that extends downward from the aperture of the main frame (13). This trim covers the distance between the fixture and the dry wall. This trim also has attached thereto clips (38) which hold a reflector (43).

In FIG. 22, the height of the fixture has been adjusted through the first bracket (1) and the second bracket (6), and the clip (4) is in a clip hole (8). The reflector (43) has been placed inside the fixture in FIG. 22.

Figure 23:
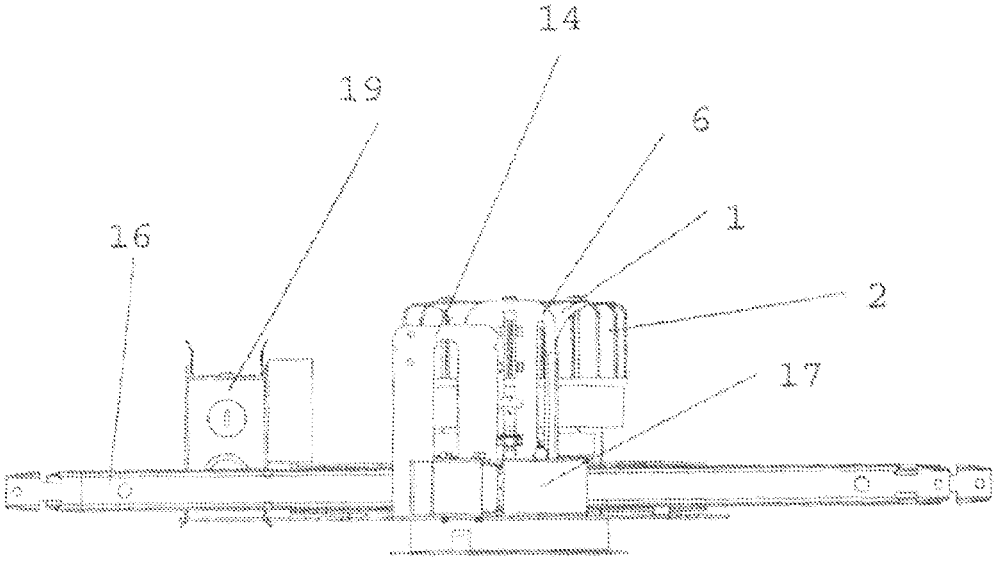
FIG. 23 illustrates a side view of a light fixture of a third embodiment of the invention with an adjustment assembly.
Figure 24:
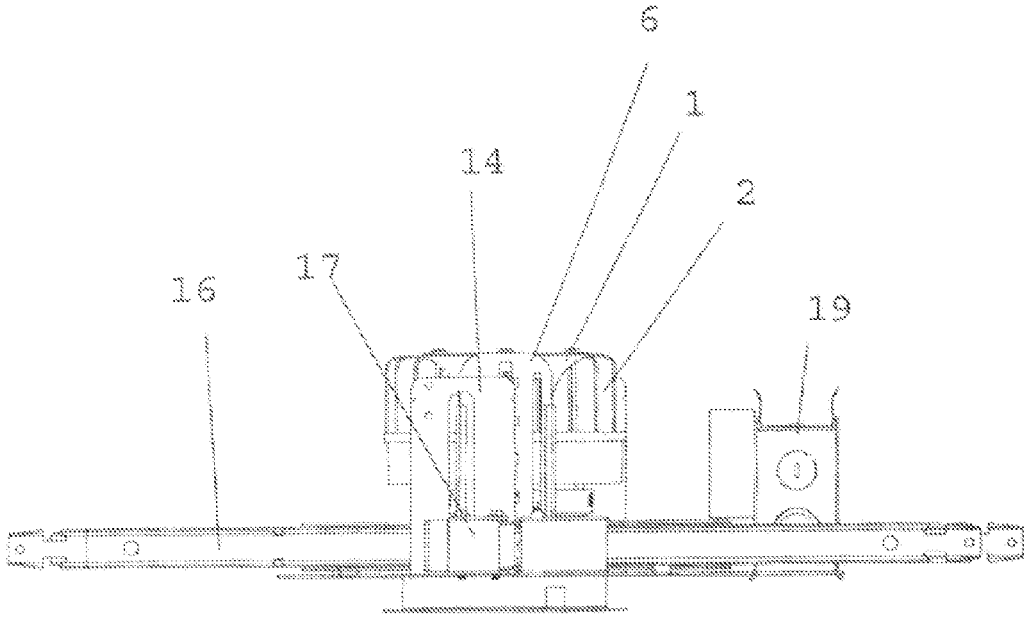
FIG. 24 illustrates a side view of a light fixture of a third embodiment of the invention with an adjustment assembly.

FIG. 23 illustrates a first side view of the fixture of FIG. 22 with the reflector (43) in place. The view shown is perpendicular to the direction of the hangers. In this view, the hanger (16) is in front and attached to the bottom of sliding path (15) of the main frame (13). The junction box is shown to the left. Clip (4) of the first bracket (1) is in clip hole (8) of the second bracket (6). The heat sink is attached to the top of the first bracket (1). Clip (38) is also visible in this view. FIG. 24 is another side view of the same fixture of FIG. 3 (after a 180 degree rotation).

Figure 25:
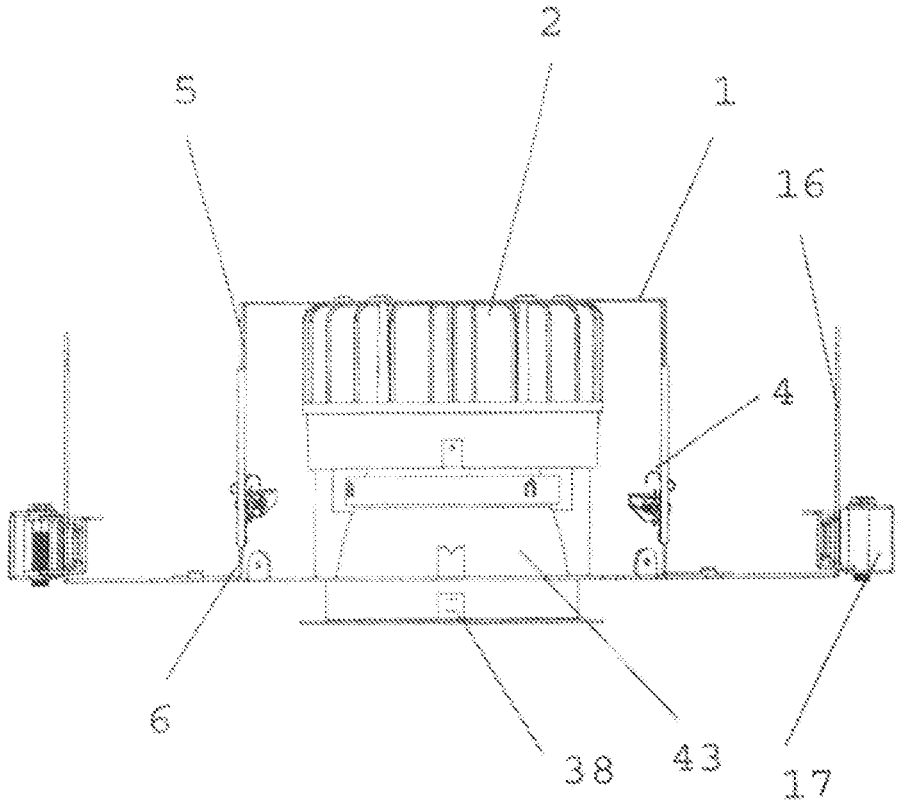
FIG. 25 illustrates a side view of a light fixture of a third embodiment of the invention with an adjustment assembly.
Figure 26:
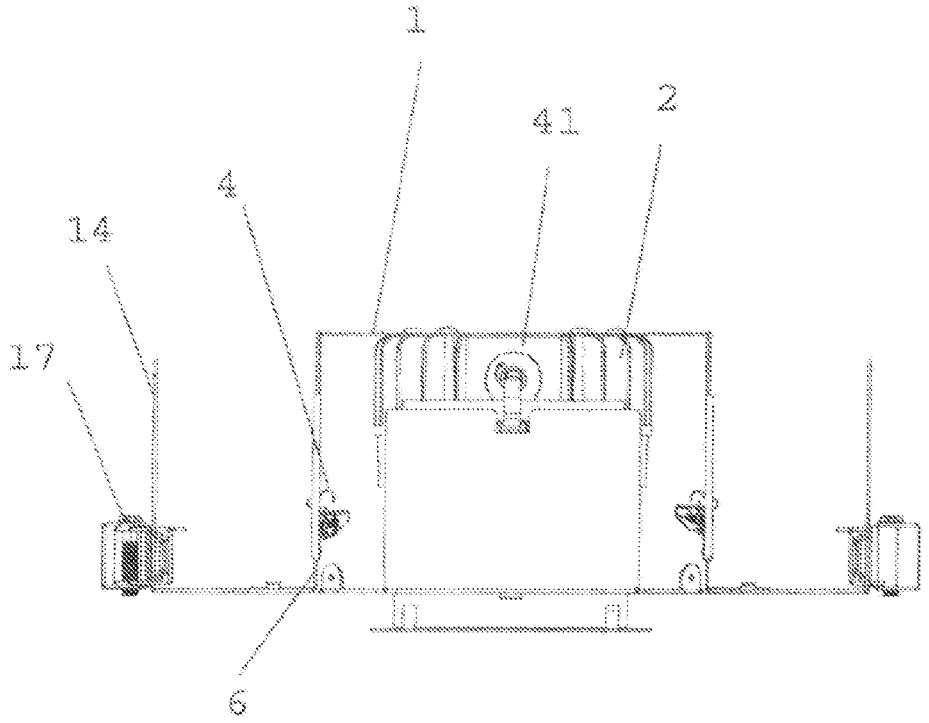
FIG. 26 illustrates a side view of a light fixture of a third embodiment of the invention with an adjustment assembly.

FIGS. 25 and 26 are side views of the fixture perpendicular in direction to an axis from one arm (14) to other arm (14) of the main frame (13). FIG. 25 illustrates that the height of the fixture has been adjusted through the first bracket (1) and the second bracket (6), and the clip (4) is in a clip hole (8) (not visible in this figure). The fixture is shown with a heat sink (2) and a convex shaped round reflector (43) that is attached to the heat sink (43). Also illustrated is clip (38) holing in place reflector (43). The junction box (19) is behind the reflector (43) in this view. FIG. 6 is another side view, where the view of FIG. 25 is rotated 180 degrees. The junction box (19) is in front in this view. The heat sink (2) is shown with a connector (41) where a conduit containing wires from the junction box enters the heat sink (2) and powers the LED light source.

Figure 27:
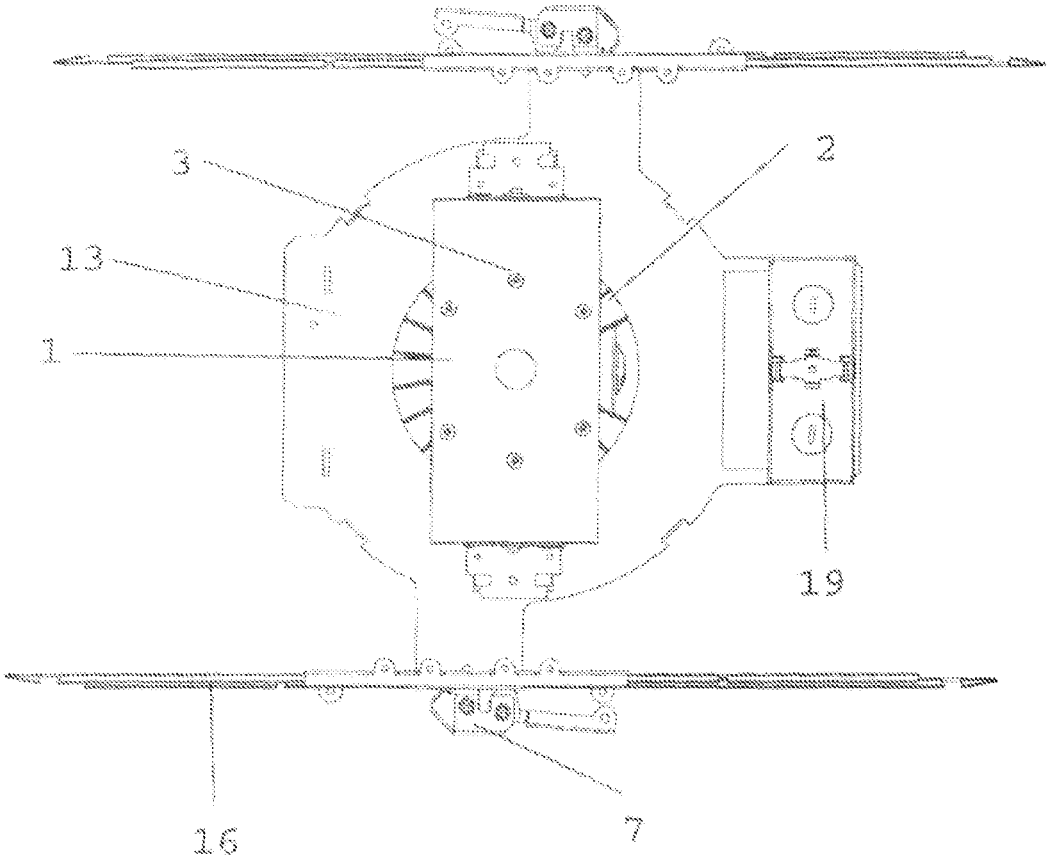
FIG. 27 illustrates a top view of a light fixture of a third embodiment of the invention with an adjustment assembly.

FIG. 27 illustrates a top view of the fixture of FIG. 21. Screws (3) of the first bracket (1) hold the heat sink (2). The Junction box (19) is on the right side of the main frame (13). Also shown are the main frame (13) and the hangers (16).

Figure 28:
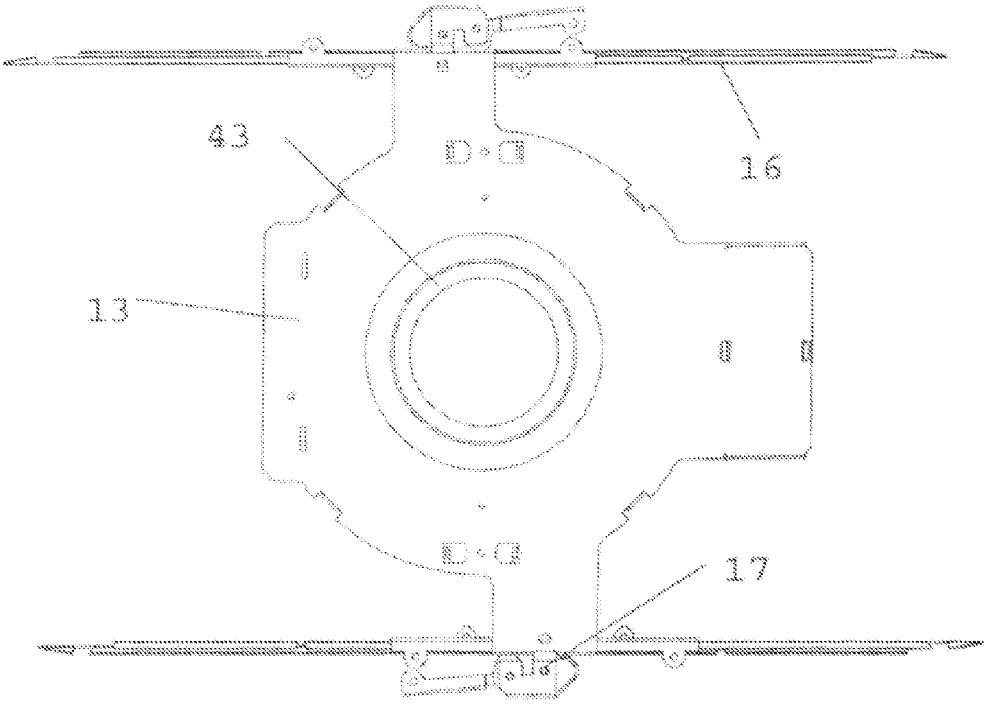
FIG. 28 illustrates a bottom view of a light fixture of a third embodiment of the invention with an adjustment assembly.
Figure 29:
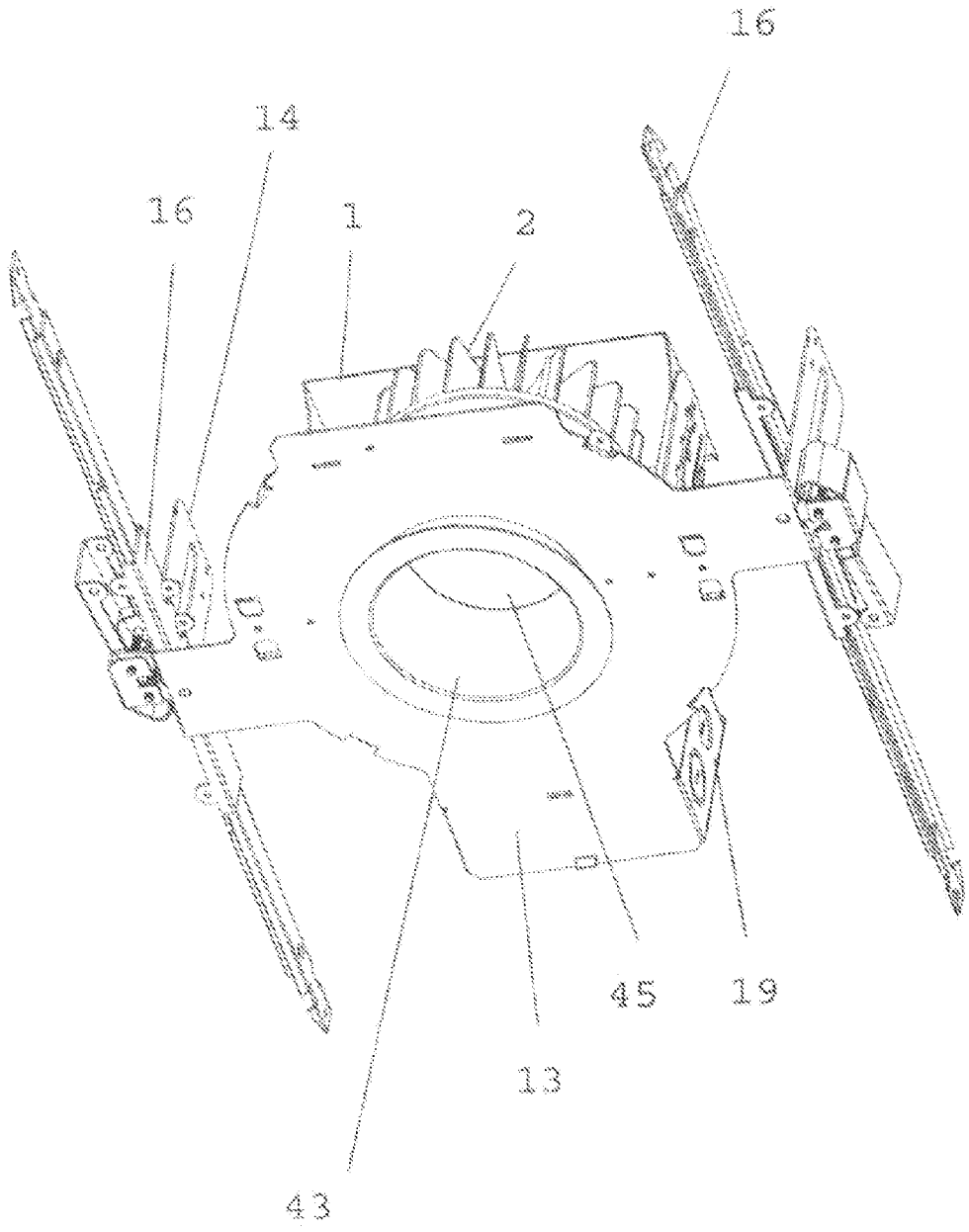
FIG. 29 illustrates a bottom perspective view of a light fixture of a third embodiment of the invention with an adjustment assembly.

FIG. 28 illustrates a bottom view of the fixture. Inside of a round shaped reflector (43) is shown. The round aperture view inside Reflector (40) is caused by the torsion spring holder (39) which touches the LED holder (46). An LED light source is behind reflector (40). The heat sink (2) is on top of the reflector. An optional glass can be placed in between the heat sink and the reflector. FIG. 29 illustrates a bottom perspective view of the fixture of FIG. 22 with the reflector (43) in place. The hangers (16) are connected to the main frame (13).

The heat sink (2) has a compartment for placing LED) lights (45). This compartment has a flat surface and typically a round perimeter. Behind the flat surface where the LED (45) is placed, the heat sink as a plurality of radially outward fins for dissipating heat. The heat dissipating section can also have a fan if desired by a user. The LED (45) is placed in the compartment with its back attached to the heat dissipating section. The LED light (45) is connected to the junction box (19) for receiving power. In another embodiment, instead of placing a naked LED against a heat sink, an LED) light is placed comes as a pre-made package (45) with its own reflector and lens. If a naked LED is used, a reflector can also be added inside the compartment of the heat sink.

Different types of LEDs (Light Emitting Diodes) can be used, including any solid state light emitting devices, such as semiconductor LED devices, organic LED devices, semiconductor laser diodes, or so forth.

The present invention has various alternative embodiments of the light reflectors with respect to their shapes. The reflector can have the shape of a frustum in the longitudinal cross section to thereby have a circular frustum shaped exterior surface. Another alternative embodiment has a convex circular exterior surface. In addition, it will be appreciated that another embodiment has a concave circular exterior surface.

Figure 30:
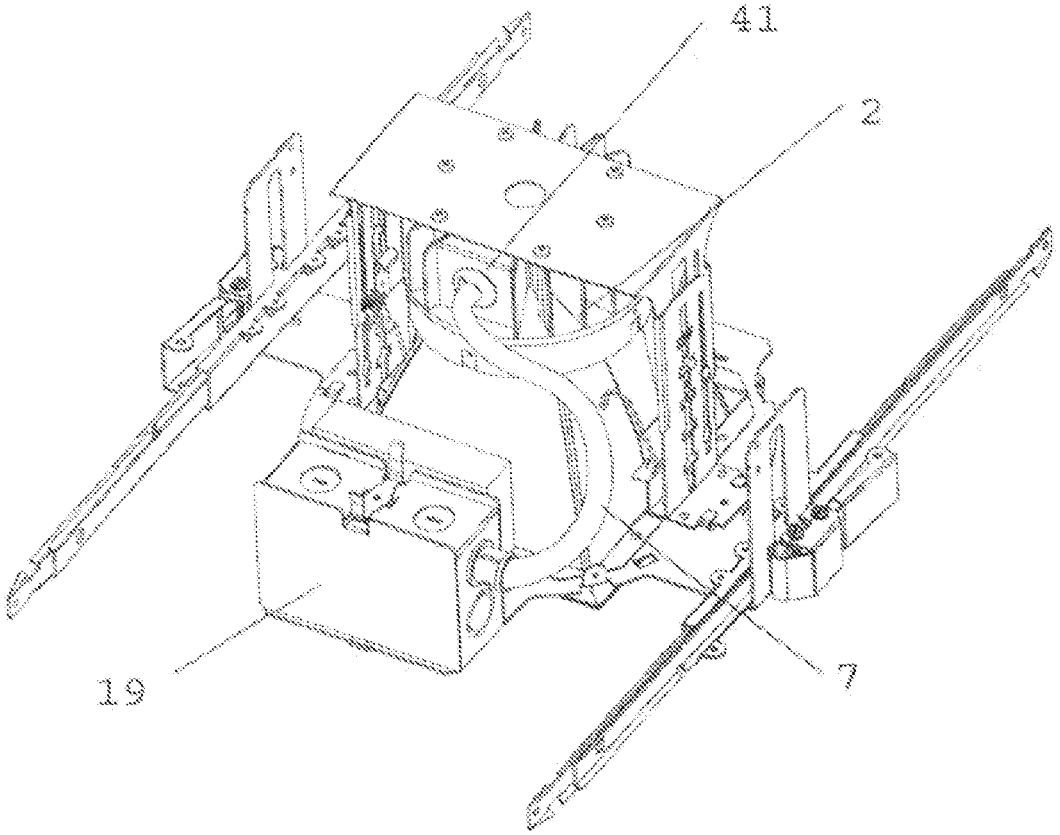
FIG. 30 illustrates a conduit that connects the junction box to the heat sink in a light fixture.

FIG. 30 illustrates a conduit (7) that connects the junction box to the heat sink in a light fixture. The heat sink (2) is shown with a flex connector (41) where a conduit (7) containing wires from the junction box enters the heat sink (2) and powers the LED light source. The conduit (7) can be screwed into the connector (41).

Figure 31:
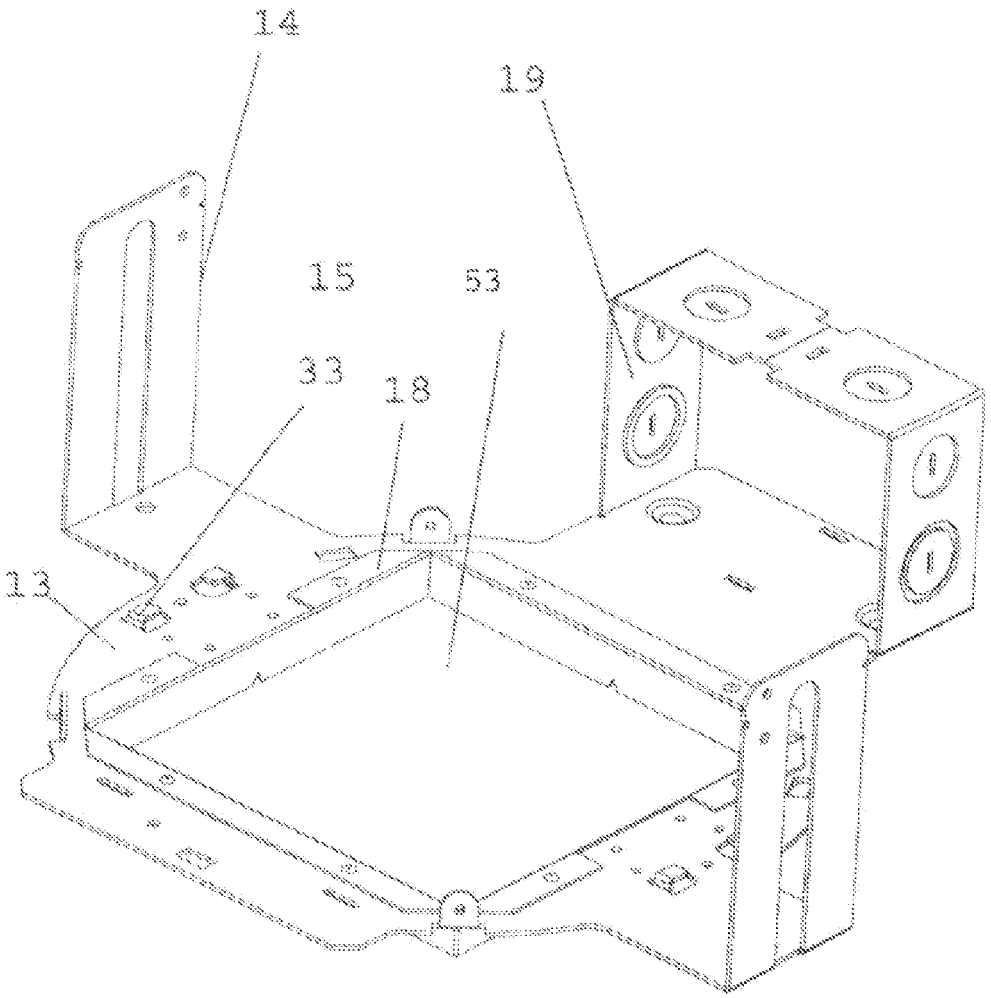
FIG. 31 illustrates a top perspective view of a frame with a square aperture.

FIG. 31 illustrates a top perspective view of a main frame (13) with a square aperture (53). A round aperture can also be used if needed. A square frame (18) is placed inside the main frame, with the trim (24) of the square frame (18) extending downward and away from the first bracket (1). The trim (24) of the square frame (18) can have an alignment gap (23) for passing through laser light. The square frame (18) can have one or more flanges (25) for attachment to the main frame (13). The flange of the square frame (18) can have gaps (35) for placement of the third bracket (12).

Main frame (13) can have arms (14) with a sliding path (15) on opposite sides for attachment to a ceiling. The arm (14) can have a sliding path (15) that allows for adjustable attachment to lock (17) of hangers. The hangers (16) are then used to hang the fixture in a recessed position in the ceiling.

Figure 32:
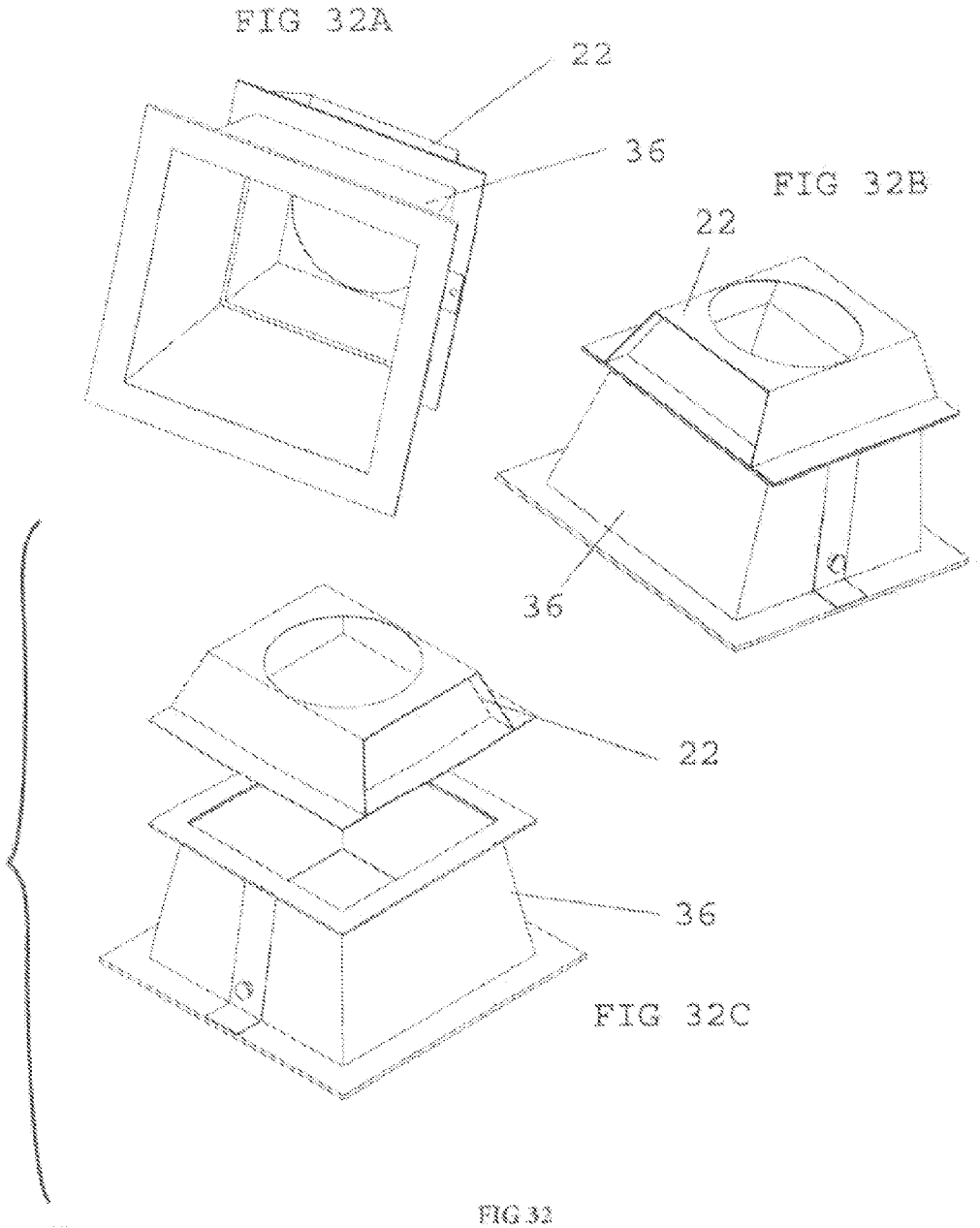
FIG. 32A illustrates a bottom perspective view of a four inch square reflector made by placing two reflectors on top of each other.
FIG. 32B illustrates a top perspective view of a four inch square reflector made by placing two reflectors on top of each other.
FIG. 32C illustrates a top perspective and exploded view of a four inch square reflector made by placing two reflectors on top of each other.

FIGS. 32A, 32B, and 33C illustrate a four inch square reflector by placing two reflectors on top of each other. In this embodiment as illustrated, the reflectors (22, 36) together form a 4 inch reflector. A first square reflector (22) is placed on a second square reflector (36). An optional lens (not used in the illustrated embodiment) can be placed in between the first square reflector (22) and the second square reflector (36).

FIGS. 33A and 33B illustrate a round six inch reflector (44). Reflector (44) has a general convex shape that increases in diameter from top to bottom. Ring (37) is placed on reflector (44). Torsion springs (21) are placed on opposite sides of the ring (37).

FIGS. 34A and 34B illustrate a round 6 inch reflector (43) comprised of two reflectors. Reflector (43) is made from a top reflector (48) and a bottom reflector (49). The top reflector (48) and the bottom reflector (49) both have a convex shape. A lens (50) can be placed in between the reflectors. A bracket (51) holding torsion spring (21) is attached to a ring (52) which is placed in the general area of where the top reflector (44) and the bottom (reflector) sit on each other.

The lens of the present invention can be round in shape and either put in between two reflectors or in between a reflector and the heat sink compartment. The lens can be transparent, frosted or translucent depending on the desired lighting effect. Where an exterior surface of a lens is frosted and an interior surface is smooth, the LED is concealed. One embodiment of the lens causes a light effect which has a spot image as it shines down from the ceiling. A second embodiment of the lens includes an exterior surface that is frosted and an interior surface that is sanded and rough, so that the lens generates a light effect which has a widely dispersed image. A third embodiment of the lens is comprised of an exterior surface, which has a multiplicity of evenly distributed raised prisms or spots throughout the surface extending perpendicularly away there from, as compared with the interior surface which can either be smooth or sanded. Therefore, the lens generates a light effect which has a more widely dispersed image. The lenses and reflectors (trims) disclosed in U.S. Pat. No. 8,408,759 are incorporated herein by reference.

Figure 35:
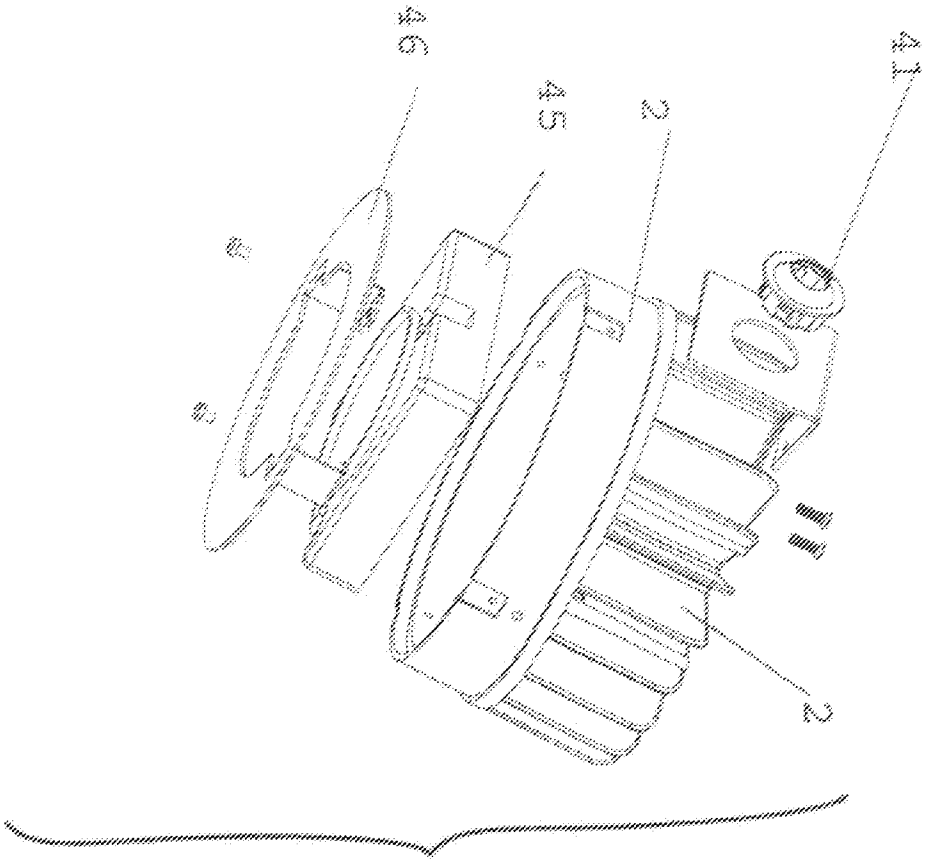
FIG. 35 illustrates a bottom perspective and exploded view of a heat sink with LED and an LED cover which are placed inside the heat sink.
Figure 36:
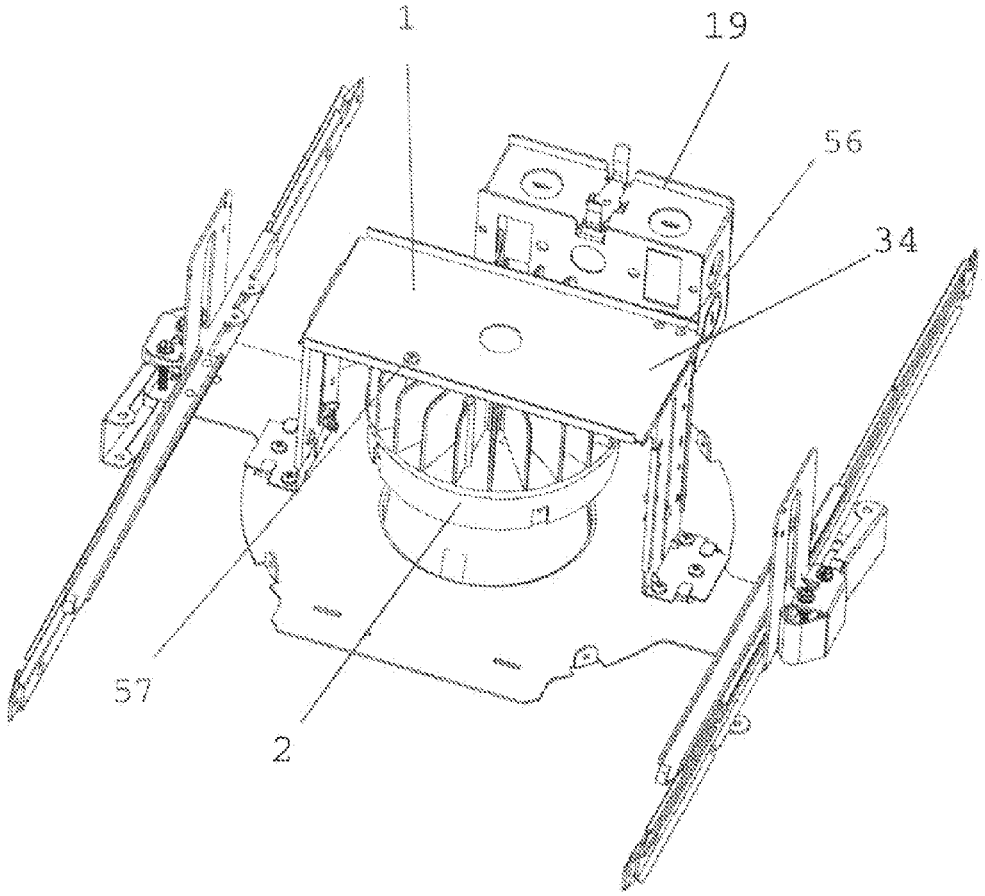
FIG. 36 illustrates a top perspective view of a light fixture with a heat sink that is capable of rotation.
Figure 37:
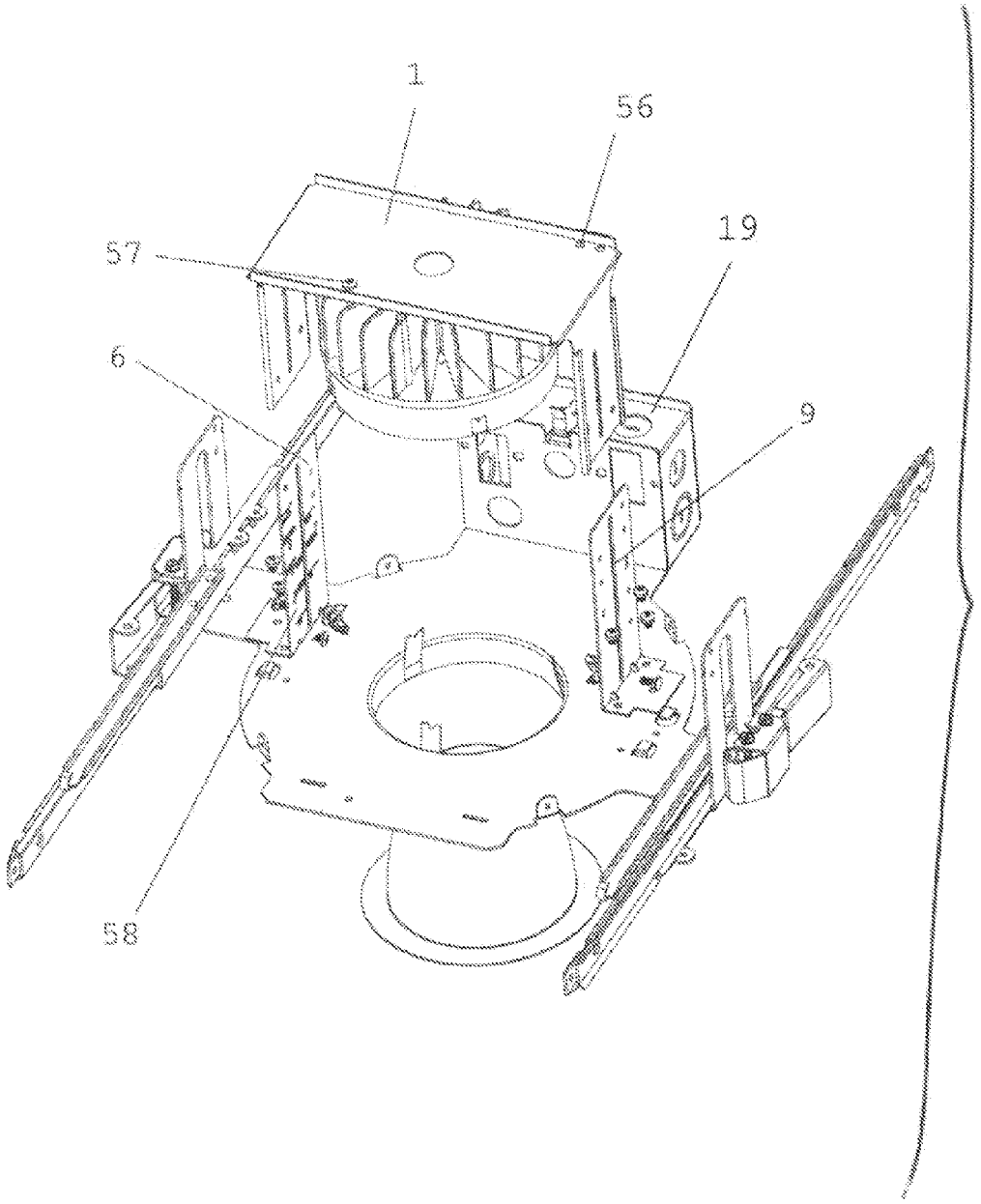
FIG. 37 illustrates a top perspective view of a light fixture with a heat sink that is capable of rotation.
Figure 38:
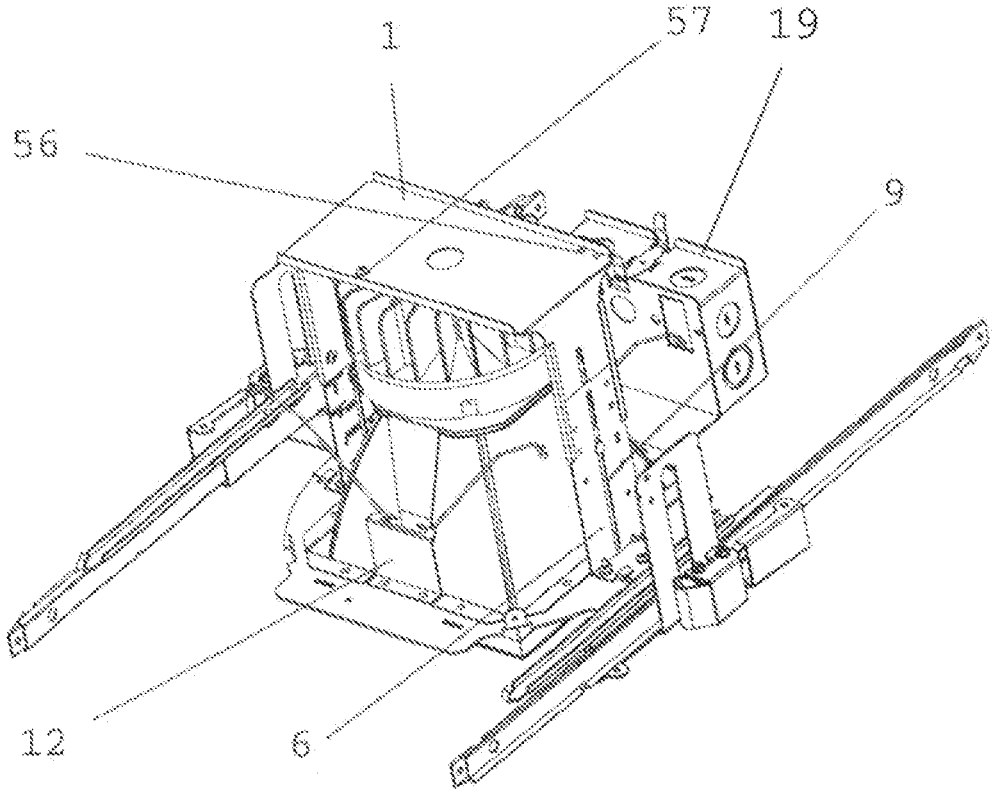
FIG. 38 illustrates a top perspective view of a light fixture with a heat sink that is capable of rotation.
Figure 39:
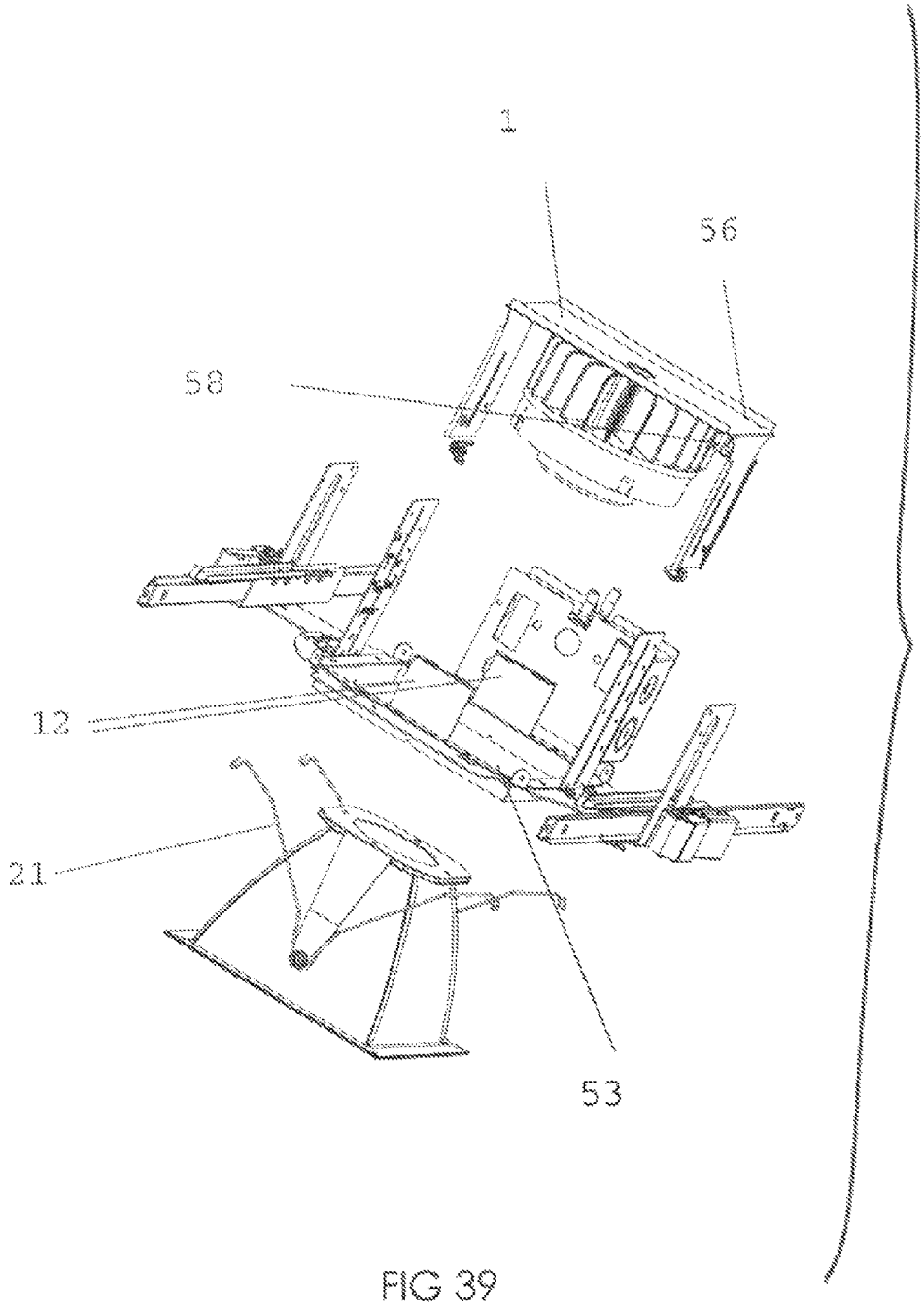
FIG. 39 illustrates a top perspective view of a light fixture with a heat sink that is capable of rotation.
Figure 40:
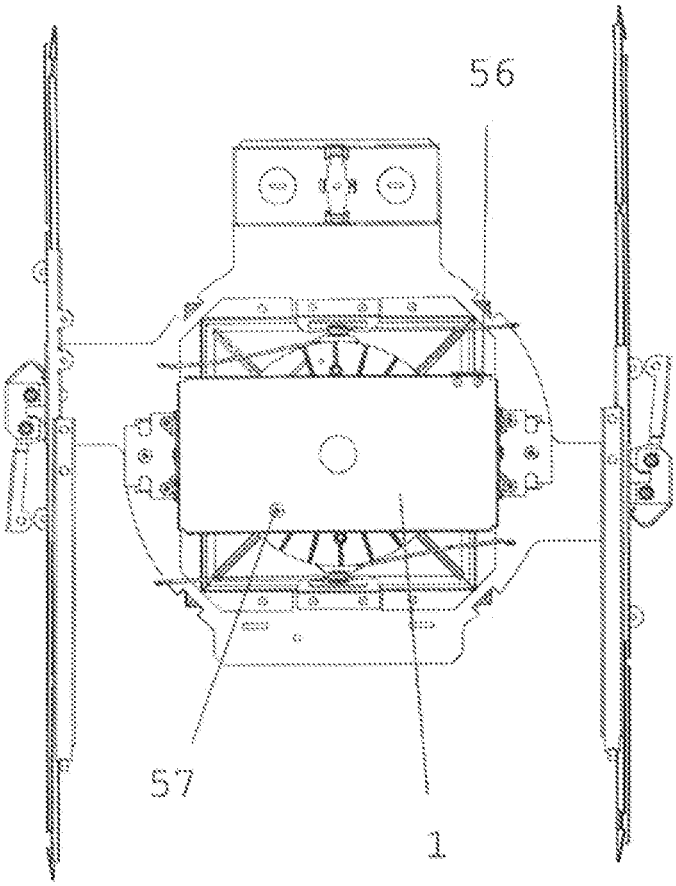
FIG. 40 illustrates a top view of a light fixture with a heat sink that is capable of rotation.
Figure 41:
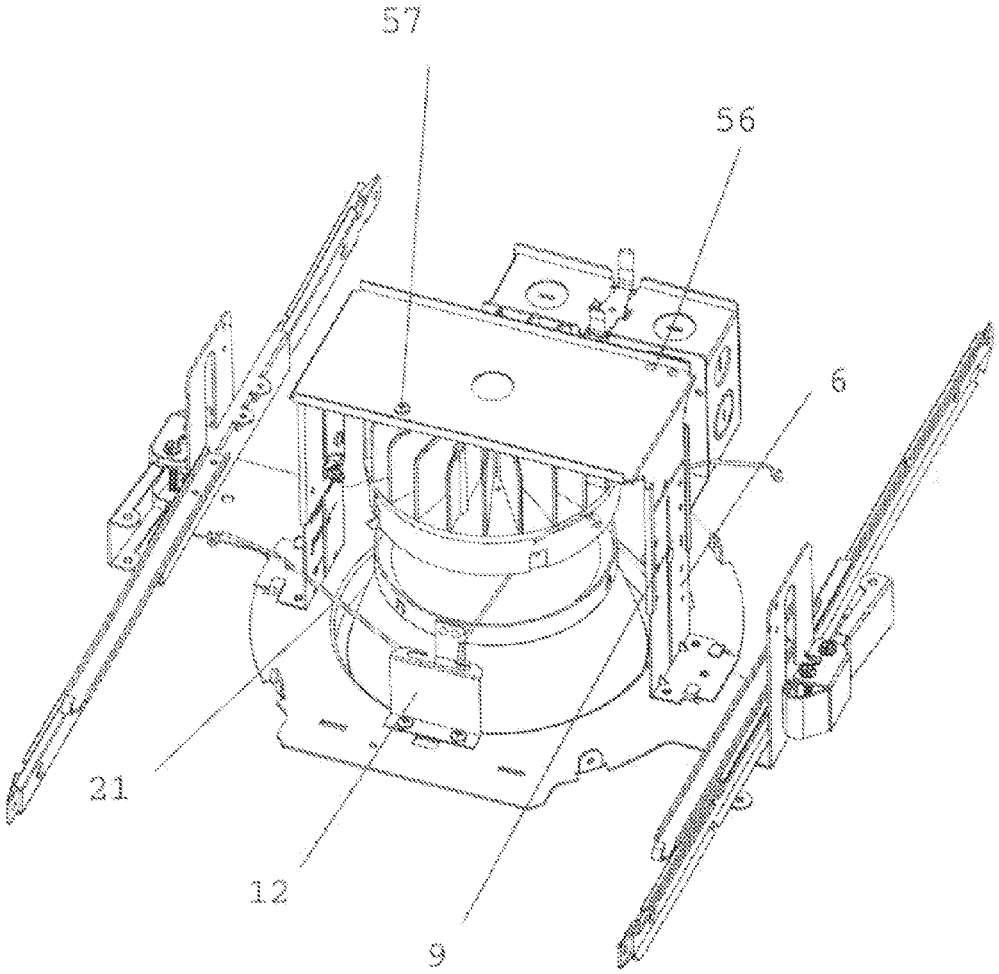
FIG. 41 illustrates a top perspective view of a light fixture with a heat sink that is capable of rotation.
Figure 42:
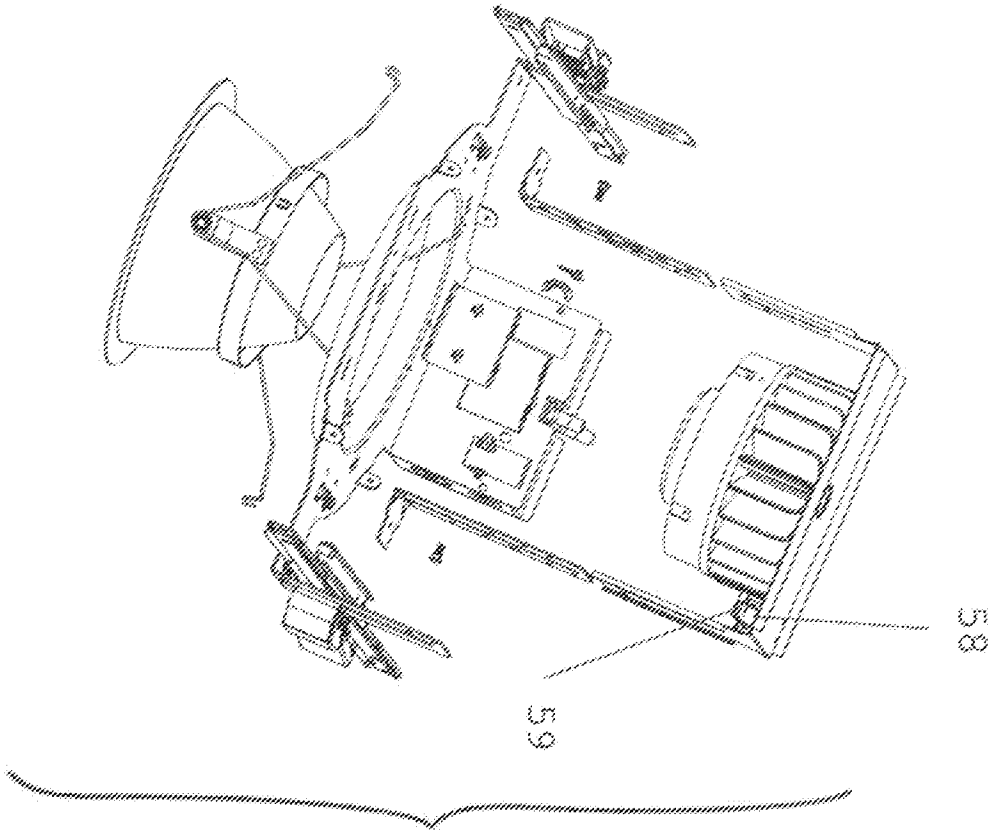
FIG. 42 illustrates a side perspective view of a light fixture with a heat sink that is capable of rotation.

FIG. 35 illustrates a perspective view of the heat sink with an LED package (45) and an LED holder (46). The LED package (45) has an LED light source, a reflector and a lens. Other LED packages can also be used. LED holder (46) keeps LED package (45) in place.

The first bracket (1) can allow for attachment of variable sizes of heat sinks (2). For example heat sinks with a diameter of about 7.5 inches to about 1 inch, such as about 4 to about 6 inches in diameter.

Different size reflectors can be used in the fixture of the present invention. The distance from the heat sink (2) to the aperture of the main frame (13) can be about 3 inches to about 9 inches, such as about 4 inches to about 8 inches. Single or combination of reflectors can be used, such as square reflectors where each side of the square is about 4 to about 6 inches, or a round reflector where the diameter of the reflector facing outside if about 4 to about 6 inches.

Figure 43:
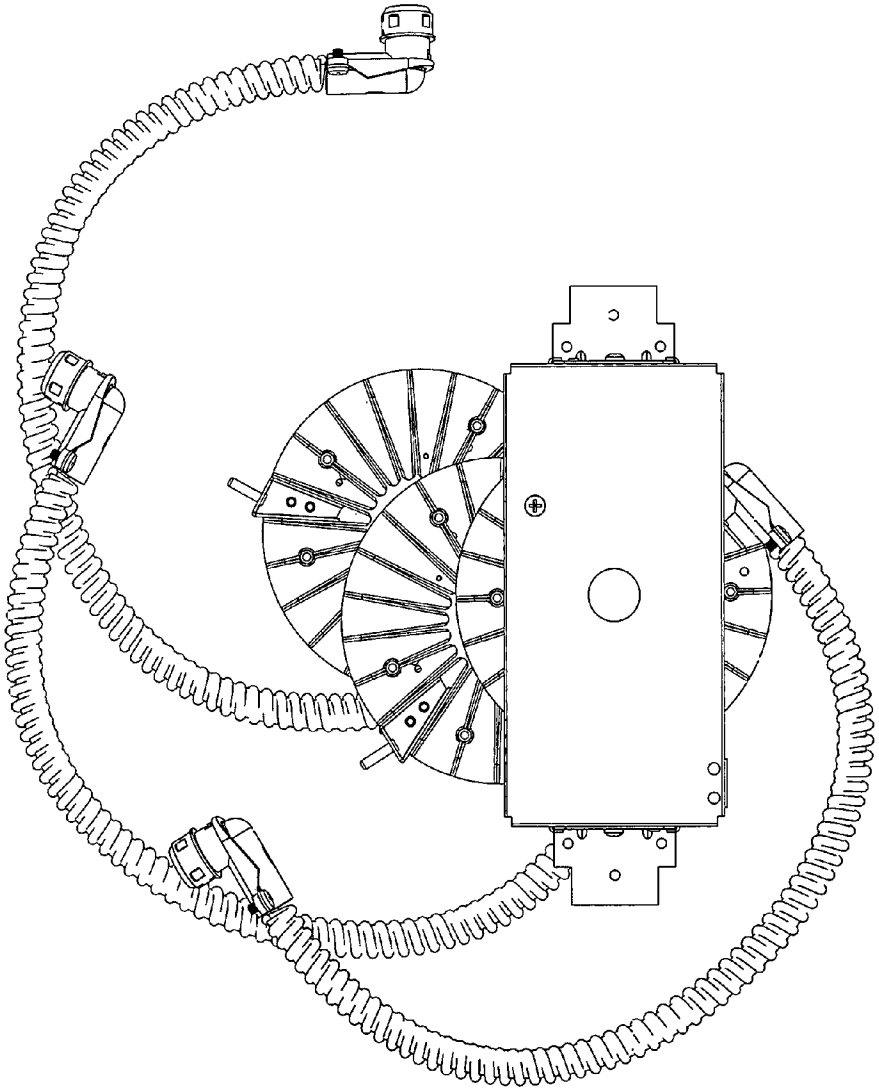
FIG. 43 illustrates rotation of heat sink of the light fixture.

FIGS. 36-53 illustrate a heat sink (2) attached to bracket (1) in a manner that allows for rotation of the heat sink (2). The rotation, illustrated in FIG. 43 allows for rotating the heat sink (2) away from the junction box (19). The rotation allows for access to the junction box (19) as needed. Heat sink (2) is rotatably attached to bracket (1) with screw (57). The heat sink (2) is held in place with lock (58) which has teeth (59). Lock (58) is attached to the bracket (1) with one or more rivets (56). The teeth (59), particularly the top tooth, move after a certain threshold force is applied. The teeth (59) have certain flexibility at point of connection that allows for movement of the teeth up and down. The bottom tooth can have a groove and the top tooth can cover the groove. When no force is applied, the teeth (59) in their natural position remain in a locked position by contacting each other. The heat sink (2) has attached thereto an extending member (61), which extends out from the side of the heat sink and fits in the groove of the teeth (59). The teeth (59) keep the heat sink (2) in position by locking into place the member (61). The member can be cylinder shaped pin. When the heat sink (2) needs to be rotated, the sufficient force applied to rotate the heat sink (2) moves one or more of teeth (59) and frees heat sink (2) from lock (59). The embodiment of FIGS. 36-53 with a rotatable heat sink (2) can be used with any of the embodiment illustrated in FIGS. 1-35.

Figure 44:
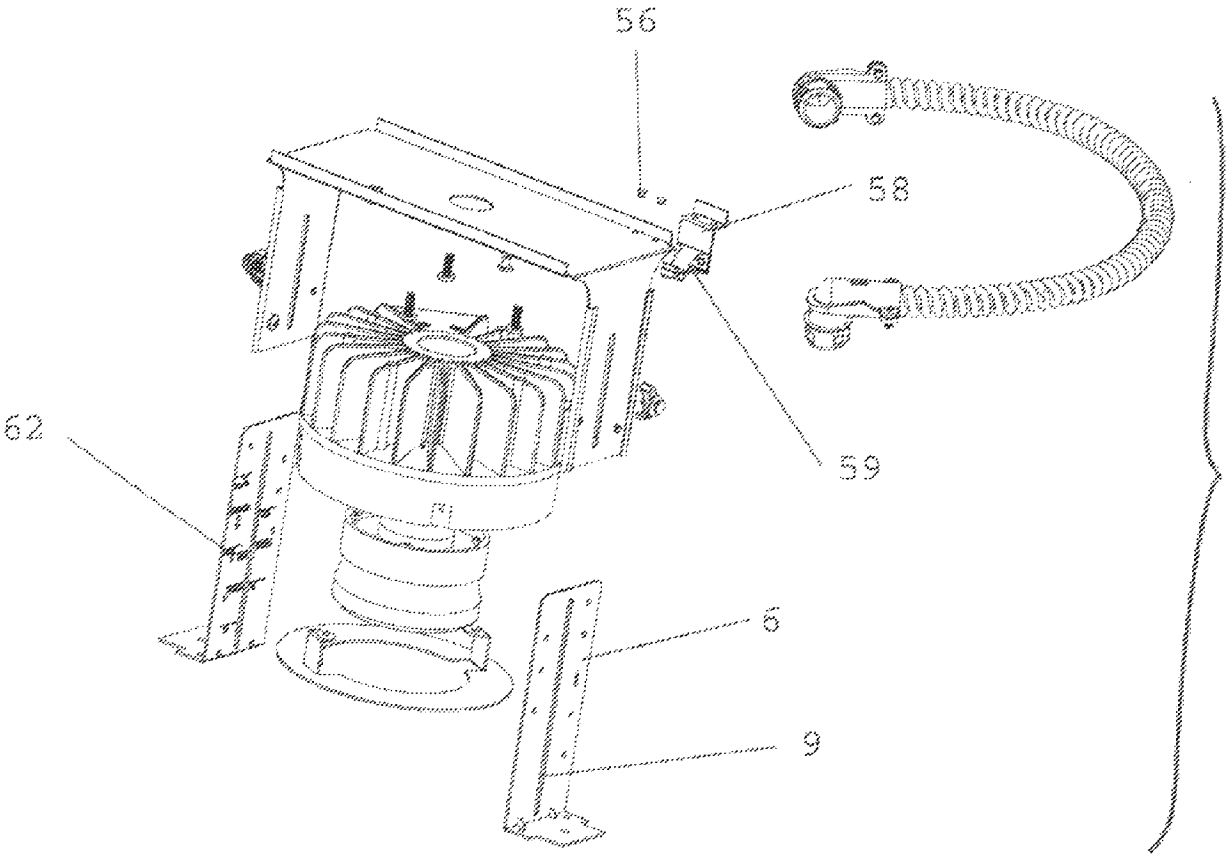
FIG. 44 illustrates an exploded view of a light fixture with a heat sink that is capable of rotation.
Figure 45:
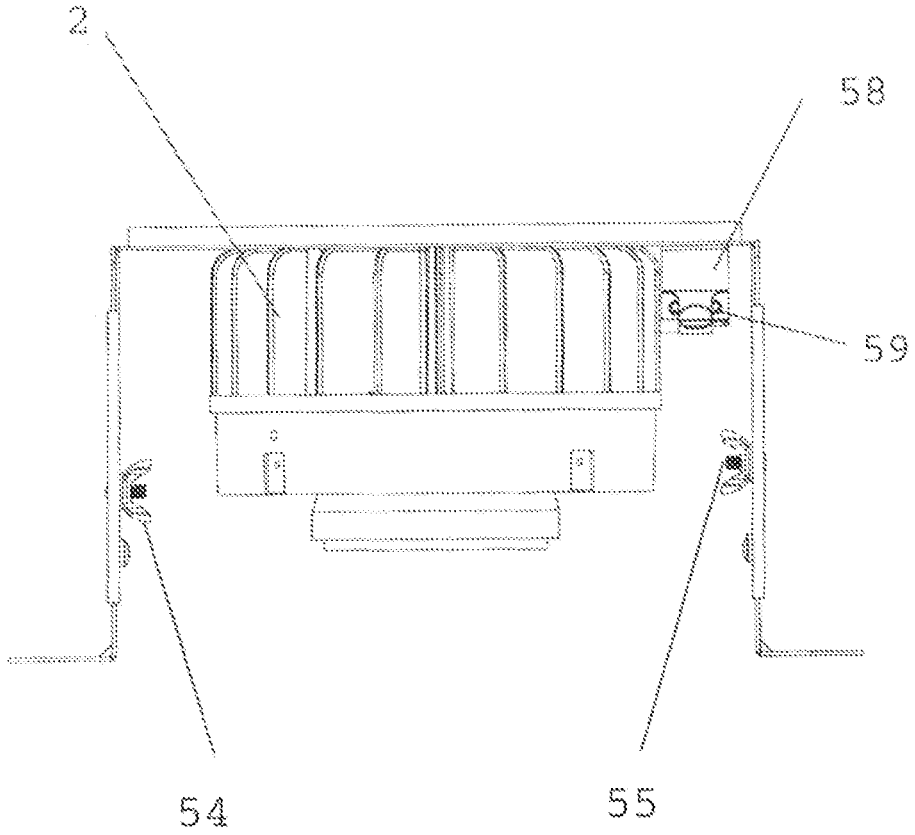
FIG. 45 illustrates a side view of a heat sink attached to a bracket.
Figure 46:
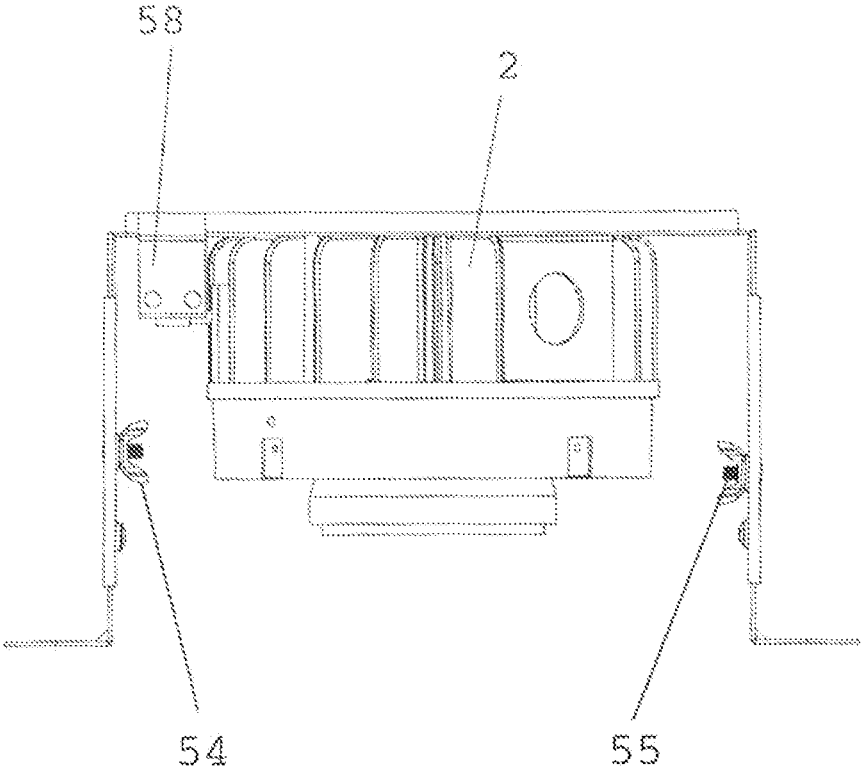
FIG. 46 illustrates a side view of a heat sink attached to a bracket.
Figure 47:
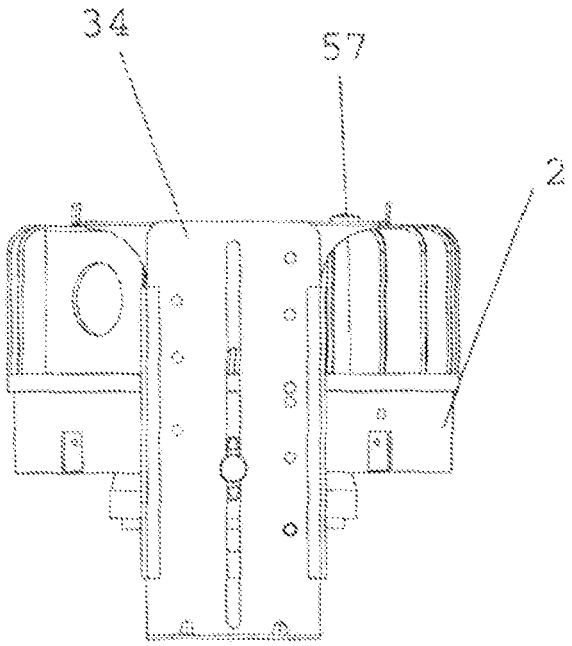
FIG. 47 illustrates a side view of a heat sink attached to a bracket.
Figure 48:
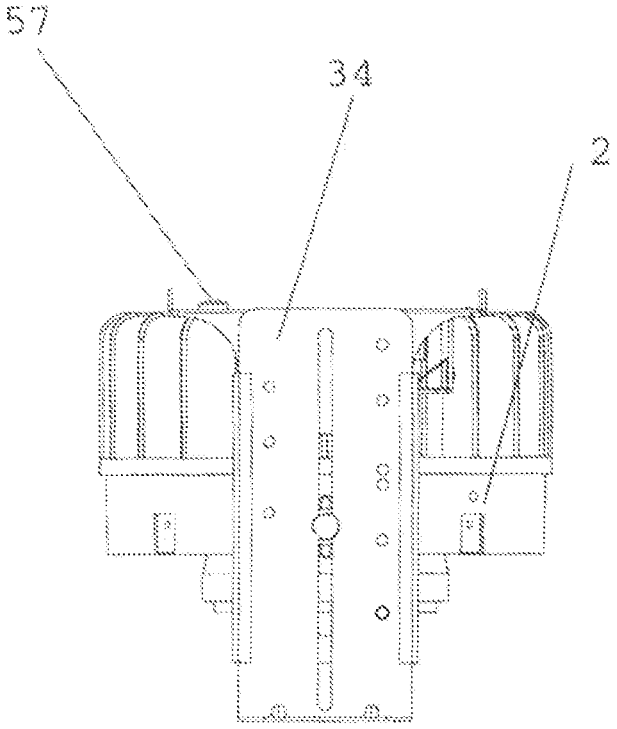
FIG. 48 illustrates a side view of a heat sink attached to a bracket.
Figure 49:
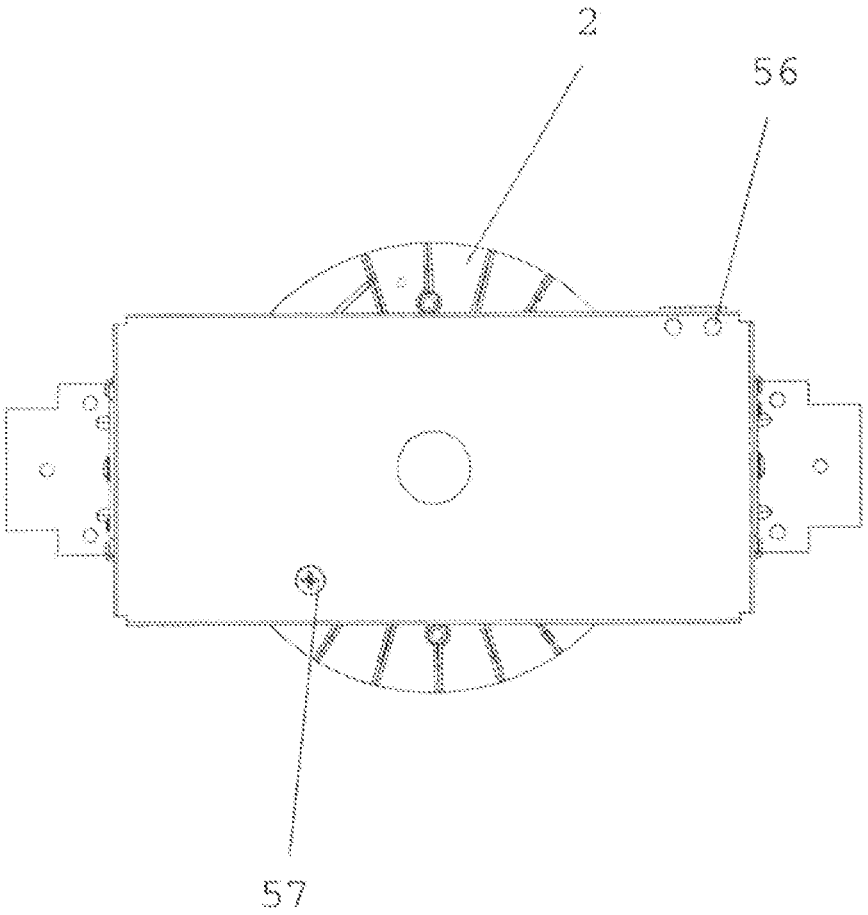
FIG. 49 illustrates a top view of a heat sink attached to a bracket.
Figure 50:
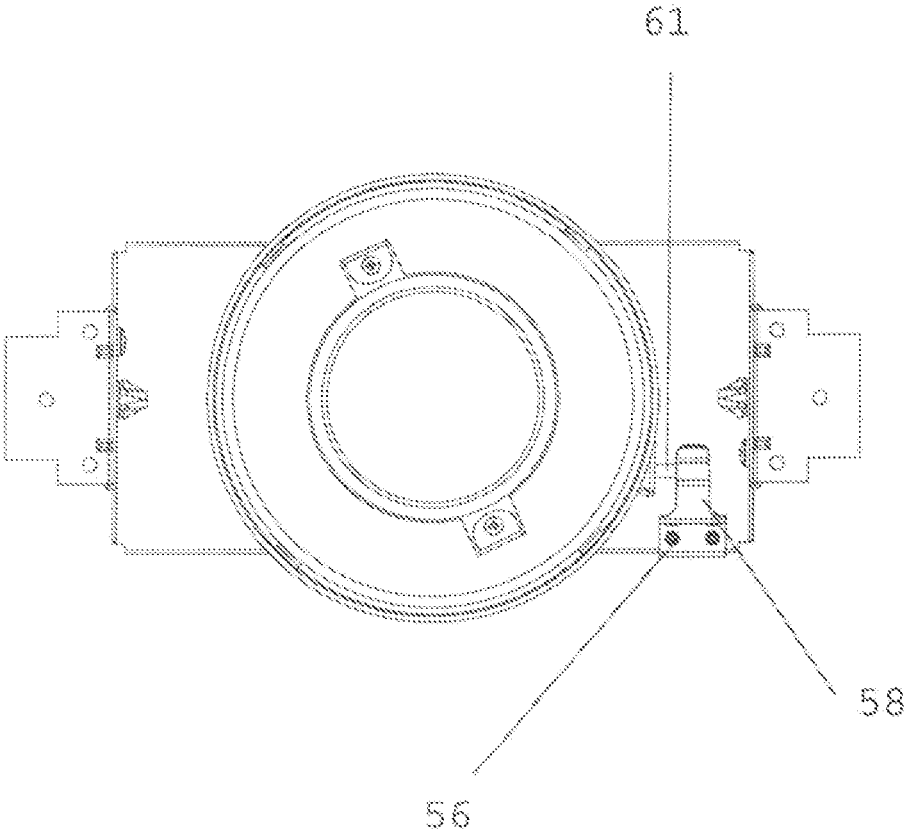
FIG. 50 illustrates a bottom view of a heat sink attached to a bracket.
Figure 51:
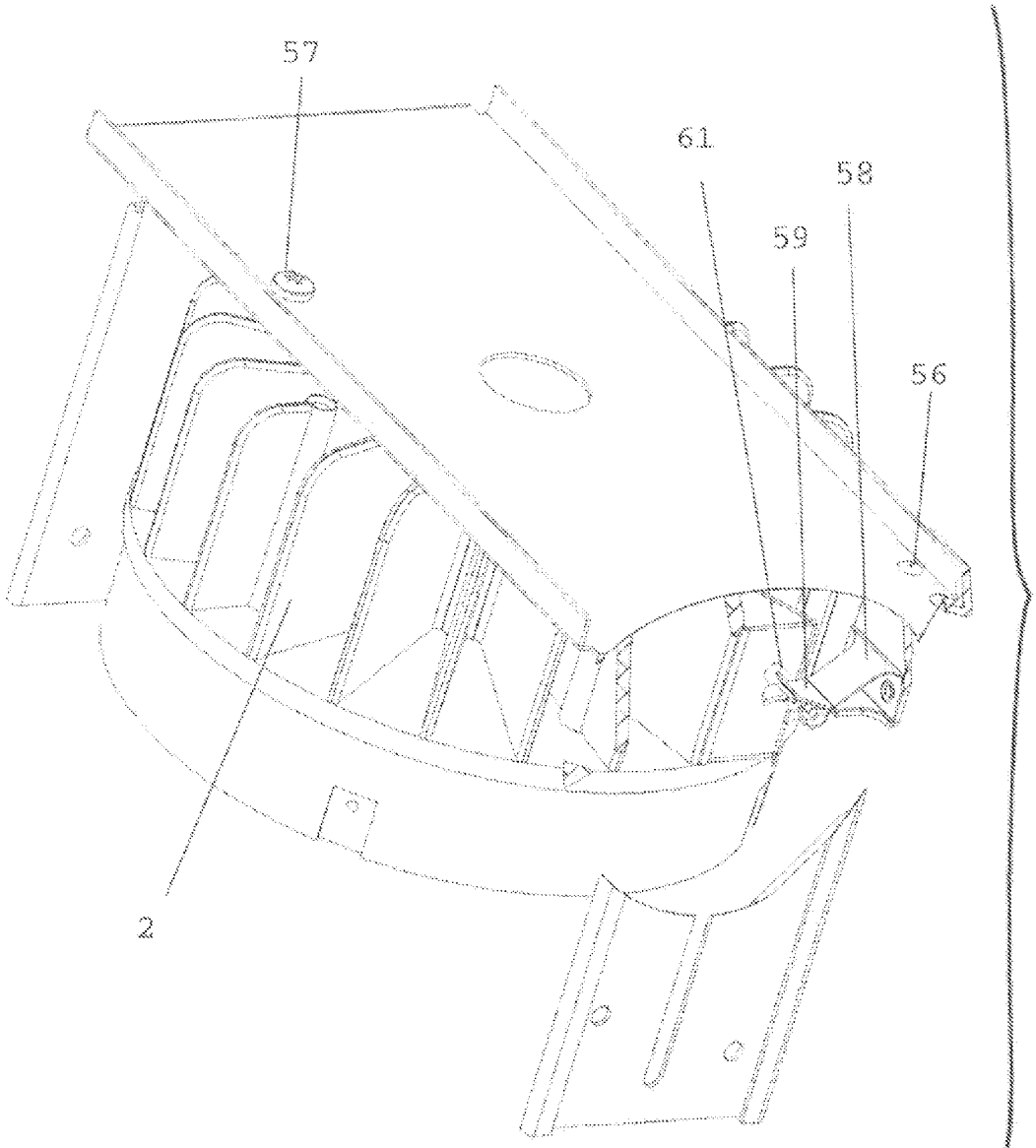
FIG. 51 illustrates a perspective view of a heat sink with a cut-off portion attached to a bracket.
Figure 52:
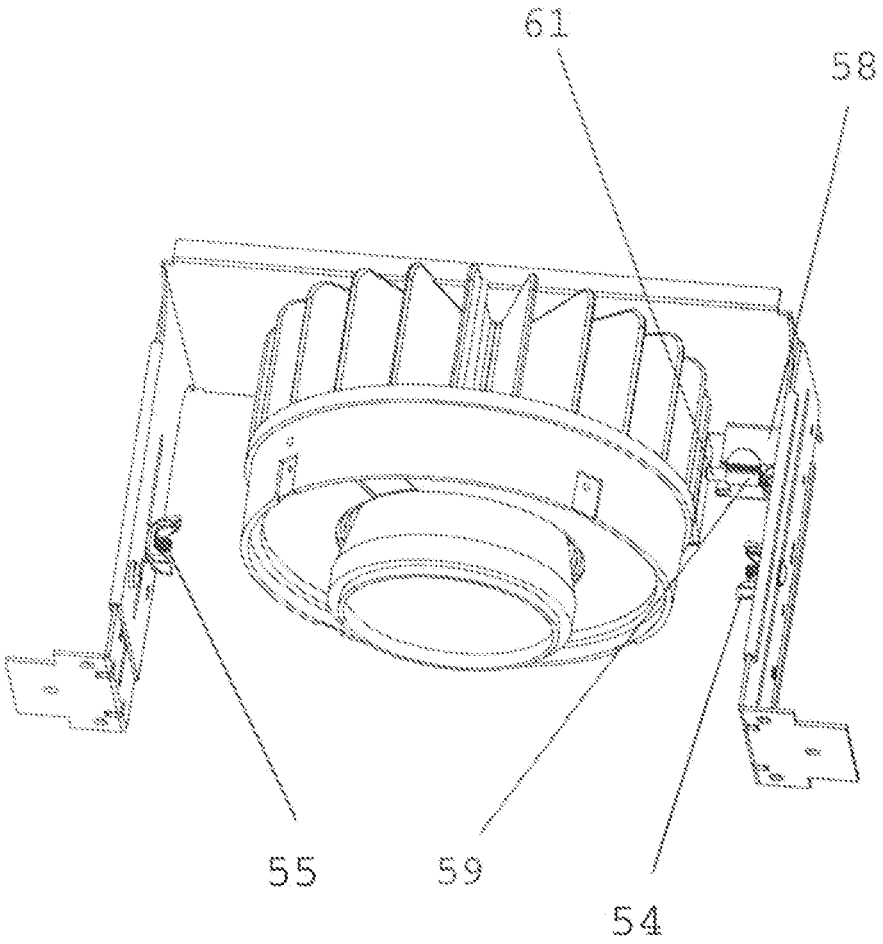
FIG. 52 illustrates a bottom perspective view of a heat sink attached to a bracket.
Figure 53:
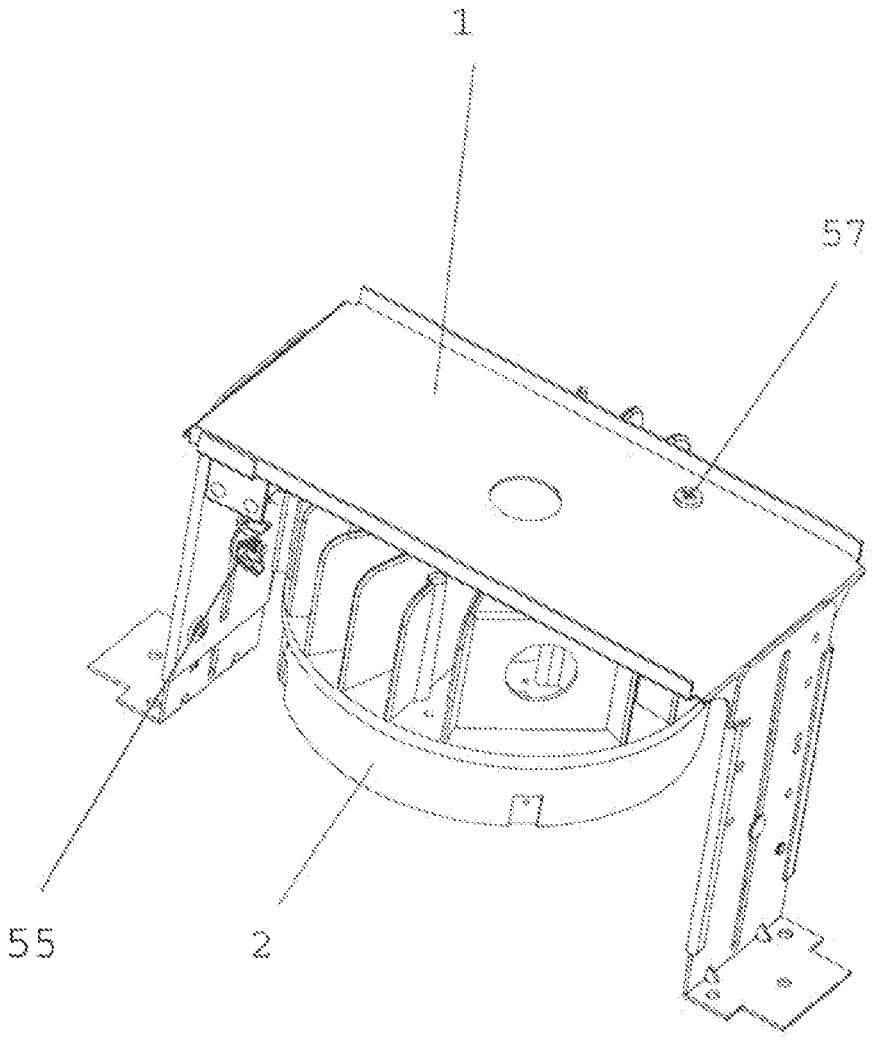
FIG. 53 illustrates a top perspective view of a heat sink attached to a bracket.

FIGS. 36-53 also illustrate the second bracket (6) with a single overlapping path (9). A separate path with clip holes (8) is not used in this embodiment. Text (62) (such as shown in FIG. 44) can be placed on bracket (6) identifying the distance between bracket (1) and any aperture (53). A nut (54) and a screw (55) can be used to lock the second bracket (6) at a desired location. The embodiment of FIGS. 36-53 with a single overlapping path (9) can be used with any of the embodiment illustrated in FIGS. 1-35.

FIGS. 38-41 illustrate placement of the third bracket (12) on the sides of the aperture that the second bracket (6) is not placed. The third brackets (12) cover two opposite sides of the square aperture and the third bracket (12) the other two opposite sides of the square aperture. The embodiment of FIGS. 38-41 with the third bracket and second bracket placed on different sides of the square aperture can be used with any embodiment that uses a square aperture.

REFERENCES NUMBERS (1) first bracket
(2) heat sink
(3) screw
(4) clip
(5) bracket arms
(6) second bracket
(7) conduit
(8) clip holes
(9) overlapping path
(10) locking knob
(11) screw
(12) third bracket
(13) main frame
(14) arms
(15) sliding path
(16) hanger
(17) hanger lock
(18) square frame
(19) junction box
(20) semi-enclosed space
(21) torsion spring
(22) reflector
(23) alignment gap
(24) trim
(25) flange
(26) disc
(27) path
(28) holder
(29) screw
(30) washer
(32) rivets
(33) bracket holders
(34) horizontal portion
(35) gap
(36) reflector
(37) trim
(38) clips
(39) spring holder
(40) reflector
(41) connector
(43) reflector
(44) reflector
(45) Led Lights
(46) LED holder
(47) ring
(48) top reflector
(49) bottom reflector
(50) lens
(51) bracket
(52) ring
(53) aperture
(54) nut
(55) screw
(56) rivets
(57) screw
(58) lock
(59) teeth
(61) extending member
(62) Text

What is claimed is:

1. A recessed light fixture comprising:

a) a first bracket with a longitudinal section and two arms, each of the two arms on opposite sides of the longitudinal section;

b) a main frame having an aperture for passage of light from an LED (light emitting diode) light source, said aperture in parallel with the longitudinal section of the first bracket;

c) a second bracket comprised of two arms with each arm of the two arms of the second bracket attached to the main frame on opposite sides of the aperture;

d) a heat sink attached to the longitudinal section of the first bracket facing the aperture, the heat sink coupled to the LED light source in a configuration that allows light from the LED light source to travel through the aperture, wherein the first bracket is configured to receive heat sinks of different sized diameters having a diameter that is less than a length of the longitudinal section of the first bracket;

wherein the arms of the first bracket and the arms of the second bracket can be adjustably and detachably attached to each other to obtain a light fixture where distance between the longitudinal section of the first bracket and the aperture of the main frame can be adjusted.

2. The recessed light fixture of claim 1, wherein both the first and the second bracket arms have a path that overlap when the first and second bracket are placed against each other, allowing the distance to be adjusted at any location in the path.

3. The recessed light fixture of claim 2, wherein a screw with a lockable knob slides along the path, allowing for locking of the knob at any location along the path.

4. The recessed light fixture of claim 1, further comprising placing a reflector in between the heat sink and the aperture.

5. The recessed light fixture of claim 1, further comprising placing two reflectors in between the heat sink and the aperture.

6. The recessed light fixture of claim 1, wherein the heat sink is rotatably attached to the first bracket.

7. The recessed light fixture of claim 6, wherein the heat sink is held in place with a lock attached to the first bracket engaging a member attached to the heat sink.

8. The recessed light fixture of claim 1, further comprising hangers and a junction box attached to the main frame.

9. The recessed light fixture of claim 1, further comprising a second frame attached to the main frame on opposite sides of the aperture.

10. The recessed light fixture of claim 1, further comprising a third bracket attached on opposite sides of the main frame on sides of the aperture where the second bracket is not attached, with the third bracket extending into the aperture and having a semi-enclosed space for holding springs attached to a reflector.

11. The recessed light fixture of claim 1, further comprising a disc with a square aperture placed on the main frame inside the fixture facing the first bracket, the disc capable of rotating in relation to the main frame, wherein the rotation of the disc allows for alignment of the square aperture of the disc.

12. The recessed light fixture of claim 1, comprising:

a disc having a square aperture that is rotatably attached to the main frame inside the fixture facing the first bracket;

wherein the square aperture can be aligned to a desired angle by rotating the disc against the main frame.

13. The recessed light fixture of claim 12, further comprising a plurality of holders attached to periphery of the main frame inside the fixture to hold the rotating disk.

14. The recessed light fixture of claim 12, wherein the rotating disc has a path through which a screw attached to the main frame slides.

15. The recessed light fixture of claim 13, wherein the disc can be fixed to the main frame by putting a nut on the screw.

16. The recessed light fixture of claim 12, wherein both the first arms and the second bracket arms have a path that overlap when the first and second bracket are placed against each other, allowing the distance to be adjusted at any location in the path.

17. The recessed light fixture of claim 16, wherein a screw with a lockable knob slides along the path, allowing for locking of the knob at any location.

18. The recessed light fixture of claim 12, further comprising placing a reflector in between the heat sink and the aperture of the main frame.

19. The recessed light fixture of claim 18, wherein the heat sink is rotatably attached to the first bracket.

20. The recessed light fixture of claim 19, wherein the heat sink is held in place with a lock attached to the first bracket engaging a member attached to the heat sink.

21. The recessed light fixture of claim 12, further comprising placing two reflectors in between the heat sink and the aperture of the main frame.

22. The recessed light fixture of claim 12, further comprising hangers and a junction box attached to the main frame.

23. A recessed light fixture comprising:

a) a first bracket with a longitudinal section and two arms, each arm on opposite sides of the longitudinal section;

b) a main frame having an aperture for passage of light, said aperture in parallel with the longitudinal section of the first bracket;

c) a disc having a square aperture that is rotatable attached to the main frame inside the fixture facing the first bracket;

d) a second bracket comprised of two arms with each of the two arm of the second bracket attached on opposite sides of the square aperture of the disc;

e) a third bracket attached on opposite sides of the main frame on sides of the aperture of the main frame that the second bracket is not attached, with the third bracket extending into the aperture of the main frame and having a semi-enclosed space for holding springs attached to a reflector;

e) an LED (light emitting diode) light source in between the aperture of the main frame and the longitudinal section;

wherein the square aperture can be aligned to a desired angle by rotating the disc against the main frame.

* * * * *